US006155028A

United States Patent [19]

Nagata et al.

[11] Patent Number: 6,155,028

[45] Date of Patent: Dec. 5, 2000

[54] METHOD AND APPARATUS FOR PACKING MATERIAL

[75] Inventors: Hiroshi Nagata; Masato Sagawa; Toshihiro Watanabe, all of Kyoto, Japan

[73] Assignee: Intermetallics Co., Ltd., Kyoto, Japan

[21] Appl. No.: 09/130,398

[22] Filed: Aug. 6, 1998

[30] Foreign Application Priority Data

Aug. 7, 1997 [JP] Japan ..... 9-225693
Sep. 22, 1997 [JP] Japan ..... 9-275132

[51] Int. Cl.[7] ..... B65B 1/24

[52] U.S. Cl. ..... 53/436; 53/523; 53/527; 141/71; 264/102

[58] Field of Search ..... 53/432, 434, 436–438, 53/510, 523, 526, 527, 529; 141/71, 73, 80, 81; 222/361; 419/66; 264/102, 120

[56] References Cited

U.S. PATENT DOCUMENTS 4,813,818 3/1989 Sanzone ..... 406/122
5,406,990 4/1995 Haeberli ..... 141/12
5,725,816 3/1998 Sagawa et al. ..... 264/102
5,775,389 7/1998 Griffin ..... 141/325
5,809,744 9/1998 Villines et al. ..... 53/434
5,826,633 10/1998 Parks et al. ..... 141/18
5,839,618 11/1998 Chatterjea et al. ..... 222/361

*Primary Examiner*—Ed Tolan
*Attorney, Agent, or Firm*—Morrison & Foerster LLP

[57] ABSTRACT

A method for packing a material includes air tapping material contained in a feeding hopper to pack it into a container which is to be filled with the material, and separating the material in the feeding hopper and the container into a portion of the material packed in the container where the material has a uniform density and a portion which is the material remaining in the feeding hopper. The air tapping process includes subjecting the space that is supplied with the material to be packed to air pressure which is switched alternately from a low pressure state to a high pressure state and back to a low pressure state or from a high pressure state to a low pressure state and then back to a high pressure state, in either case causing the material to be packed to a high density. The portion of the material remaining in the feeding hopper is separated from the portion of the material packed in the container where the material has a uniform density by a grid provided in the opening of the feeding hopper located toward the container. The container into which the material is packed may be the cavity of a die used in the die pressing of compacts, such as a rubber mold used in cold isostatic pressing.

7 Claims, 26 Drawing Sheets

G
g3
p
g2
g1
C
c1
s

G
h1
h2
p
C
g2
c1
s

G
h1
h2
p
g2
C
s

G
g3
p
g2
g1
C
p
s

G
M
h1
h2
p
g1
g2
17
18
19
16
m1
12
m
m2
s
8b
8
9

METHOD AND APPARATUS FOR PACKING MATERIAL

FIELD OF THE INVENTION

This invention relates to a method and apparatus for packing a material comprising a powder, or granular material or stapes (hereinafter simply referred to as "material") into a space formed by a rubber mold having at least one cavity therein, a punch and a cylindrical body into which the punch is inserted, or a container, a bag or a space enclosed with boards. The space formed by a rubber mold with a cavity, punch and a cylindrical body, the space in a container, the space in a bag, or the space enclosed with boards and the like is hereinafter simply referred to as the "space".

BACKGROUND OF THE INVENTION

As methods and apparatuses for packing a material into the space formed by a rubber mold with a cavity, punch and a cylindrical body into which the punch is inserted, or a container, a bag or a space enclosed with boards or the like, the following have been known:

The method in which a material to be packed is weighed with an automatic weighing device and then the material is packed into a container, and the method in which a measuring cup is used to measure the volume of the material to be packed and then the material is packed into a container.

Another well known packing method is shown in FIG. 26. A container(s) formed with a cylinder (1) and a punch (2) inserted therein is filled with a material provided in a box (3) having an opening in the bottom, by driving a piston rod (4) of a cylinder (not shown) so that the box (8) slides on the table 5 and cylinder (1) to be the box (8) and attached to a driving axis (6*a*) or a motor (6), container(s) is filled with the material.

The packing methods described above may ensure accurate weighing of material. However, in those methods, not only the weighing process, but also the packing process takes time, therefore they are not good in terms of work efficiency. In addition, due to the generally poor flowability of material such as powder, packing of weighed material into the cavity is not smoothly carried out, which consumes even more time. The poor flowability causes material to form bridges, and pores and voids tend to generate in such a material. Therefore, the density of the material filled into the container becomes uneven, especially in containers with complex shapes. In the powder compaction methods in which a powder is compacted in a cavity of a die or a rubber mold, the unevenness of the density of the material filled into the container (cavity) reduces the near-net-shape performance of the compacts and causes cracking or chipping of the compacts. A good packing method without having such problems has long been sought.

In the method using measuring cups or the like, the disadvantage is that if the material has poor flowability, bridges are formed in the material to be weighed. The bridges cause pores to form in the material, which affects the accuracy of the volume measurement.

Also, in the method illustrated in FIG. 26, due to the poor flowability of the powder, the material does not smoothly pour into the cavity(s) from the box (3). Therefore, it takes time to fill the cavity(s) with the powder, and bridges tend to form in the powder packed in the cavity, causing uneven distribution of the powder in the cavity(s). It is difficult for this method to perform the packing evenly throughout the cavity, and moreover, if the container has a complex shape or long and narrow shape, the unevenness of the packing density in the cavity becomes a serious problem.

In addition to the unevenness of the packing density described above, conventional packing methods and apparatuses for packing material have the disadvantage of low packing density of the material because of bridges and voids formed in the material packed in the cavity. In the die pressing method, if the powder in the cavity has a low packing density, the upper and lower punches have to move a long distance. This causes such problems as the powder is caught between the punches, and the unevenness of the density of the compact in the direction parallel to the pressing direction becomes very large. In the pressing methods using rubber molds such as rubber isostatic pressing method (RIP), and cold isostatic pressing method (CIP), in which a rubber mold is filled with a powder and then pressed in water or oil is used, the problem is that the obtained compacts have a so-called obvious "elephant foot" deformation. In products sold in the form of a container filled with powder, if the packing density is low at the time of the production though it appears to be fully packed with powder, because the density is increased by vibration or other causes during the transportation, a large space is formed in the container which reduces the quality of the product.

It is the object of this invention to solve the problems described above and to provide a method and apparatus for packing a material into a container rapidly as well as uniformly and in a highly densified condition throughout the container. Packing techniques in the fields of powder metallurgy or the packaging industry can be improved by this invention.

SUMMARY OF THE INVENTION

In order to achieve the features stated above, the present invention presents first an air tapping process for packing a material provided in a feeding hopper into the container to be filled with said material, and a method for separating the material existing in both the container to be filled and feeding hopper into a portion of the material packed in the container where the material has a uniform density, and a portion of the material remaining in the feeding hopper;

second, a method for separating the material in the feeding hopper from the material packed in the container with a uniform density comprising a grid element which is provided in the opening of the feeding hopper located on a side toward the containers;

third, the method for packing a material in which the container to be packed with the material is a cavity of a die used in die pressing;

fourth, the method for packing a material in which the container to be packed with the material is a cavity of a rubber mold used in rubber isostatic pressing;

fifth, the method for packing a material in which the container to be packed with the material is a cavity of a rubber mold used in the cold isostatic pressing;

sixth, an apparatus for packing a material comprising a feeding hopper loaded with a material to be packed, a means for air tapping for packing the material in the feeding hopper into the container, and a means for separating the material existing in both the container and the feeding hopper into the portion of the material packed in the container with a uniform density and the portion of the material remaining in the feeding hopper, and seventh, the apparatus for packing a material in which the means for separating the portion of the material packed in the container with a uniform density from the portion of the material remaining in the feeding hopper comprises a grid provided in the opening of the feeding hopper located toward the container.

DETAILED DESCRIPTION OF THE INVENTION

Figures 1A, 1B, 1C, 1D:
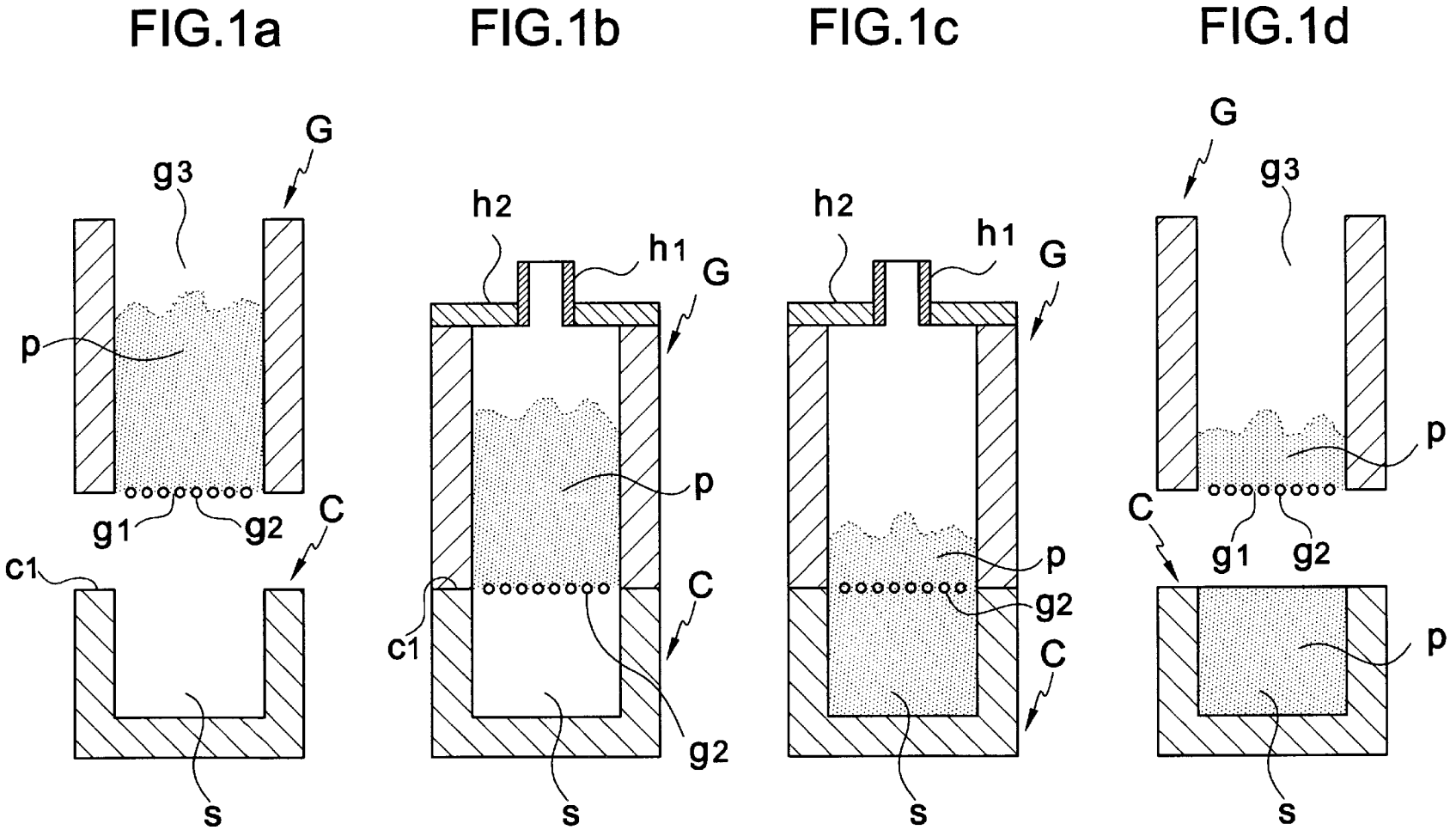
FIGS. 1*a*–1*d* are a vertical cross-sectional view of a part of an apparatus including a feeding hopper by which a powder packing method of the present invention is carried out.

The principles of the packing method disclosed in the present invention are now described.

When a powder is packed into a container where "to pack" means to pour a powder into the container due to poor flowability of the powder, bridges tend to form in the powder in a disordered fashion. Therefore, the quantity of the powder filled into the cavity varies at every packing, and the packing density of the powder in the cavity varies at every portion.

We found that if powder could be filled into the cavity without forming bridges, it would become possible to fill the container with material in a fixed quantity and with uniform packing density. We found such a powder with uniform packing density in the bottom part of the container when we packed a powder into a container by means of the air tapping described later. Then we mounted a cylindrical feeding hopper on the space of the container so that the space in the feeding hopper and the space of the container forms a connected space, and applied the air tapping to the powder existing in the space. The air tapping is carried out for the powder existing both in the feeding hopper and the space of the container so that the powder existing both in the feeding hopper and the space of the container so that the powder existing in the feeding hopper that was agitated with strong air blow accompanying the air tapping was removed and a part of the powder without forming bridges and thus with a uniform packing density was left in the container.

As the method for separating the powder in the feeding hopper from that in the container after air tapping, we considered that methods including the following two options are possible: (1) sliding the feeding hopper parallel to the container, or (2) inserting a thin plate made of metal or the like between the feeding hopper and the container.

This invention provides a more advanced method by providing a grid element or screen in the bottom opening of the feeding hopper. The installation of the grid element is effective when it is used in combination with the air tapping. A powder provided in the feeding hopper flows through the grid element into the container when subjected to the air tapping. The powder in the feeding hopper falls more and more by continuing air tapping, and eventually stops falling when it arrives at a saturated state. By this time, the powder has been agglomerated to some degree, and by lifting the feeding hopper, the powder in the feeding hopper and that in the container can be separated with the grid element or screen, when dropping of powder from the feeding hopper no longer occurs. This effect of the grid element to hold the considerably solidified powder has great value in terms of industrial implementation of the present invention.

The grid suitable for use in this invention includes one or more wires or elongated members, arranged so as to separate packed material from remaining unpacking material. FIGS. 28(A) through 28(E) depict examples of suitable grids, which are not limited to those shown. Although the exemplified grids are essentially planar, this is not a requirement of the invention. Suitable grids can be bent or be made so as not to lie in a single plane, as long as the grid achieves the function necessary to carry out the invention.

Subsequently, an important constituent element of this invention, the air tapping, is explained.

The air tapping method disclosed in U.S. Pat. No. 5,725,816 is a method for packing material into a container. The air tapping technique disclosed in this patent comprises the steps of (1) setting a feeding hopper so that the space of the feeding hopper and the space of the container are connected, (2) pouring the material through the feeding hopper into the container, (3) reducing the air pressure in the space comprising the space of the feeding hopper and the space of the container by evacuating the air therein, and subsequently, increasing the air pressure by introducing air therein, and subsequently, increasing the air pressure by introducing air into the same space, and pushing down the material into the container by evacuating air at a low flow speed, and introducing air at a high flow speed, and repeating the air evacuation and air introduction so that the material is more and more pushed down into the container, and lastly, (4) pressing down the rest of the material left in the feeding hopper with a pusher so that the material is completely packed into the container. The step (3) described above is carried out in a few seconds by high-speed valve operation. Synchronizing with the cycle of air evacuation and air introduction, the material is pushed down. This movement resembles that of the material when the container is mechanically lifted and immediately brought down to hit upon the floor. Such a mechanical operation is called "tapping". Therefore, hereinafter the process mentioned as the step (3) above is simply referred to as "air tapping". This air tapping process is also disclosed in U.S. Pat. No. 5,725,816 as including subjecting the space that is supplied with the material to be packed to air pressure which is switched alternately from a low pressure state to a high pressure state and back to a low pressure state or from a high pressure state to a low pressure state and then back to a high pressure state, in either case causing the material to be pacled to a high density.

The principles of the present invention described above may be embodied in various forms. First, the packing method of this invention is explained referring to FIGS. 1 and 2.

In FIG. 1(*a*), a container C has a space (8) to be filled with material and has an opening on the top. A hopper G for feeding material (referred to as the "feeding hopper") has openings in its top and bottom and is designed so as to be mounted on c1, the upper end of the container C. To the bottom opening of the feeding hopper G, a grid element g2 is attached. The grid element g2 may comprise wires formed in parallel by a certain distance, or meshes of a certain size, a screen or a thin metal plate punched to have a number of holes of uniform size. The material for the grid element g2 may be various kinds of mechanically strong metals, or carbon fibers. Because one of the functions of the grid element g2 is to hold the material in the feeding hopper G which is slightly solidified after air tapping so as to prevent the material from dropping, the grid size should be properly small. Too large a grid may allow material to drop through it from the bottom opening (g1) of the feeding hopper G, because such a large grid cannot hold the solidified material. On the other hand, the grid element should be large enough to allow material smoothly to drop through it. Feeding hopper G is loaded with material to a certain depth. The grid size (or thickness of the wire, mesh size, or size of punched holes) should be adjusted so as to balance the above two functions: the material-holding function and the material-releasing function.

Figure 2:
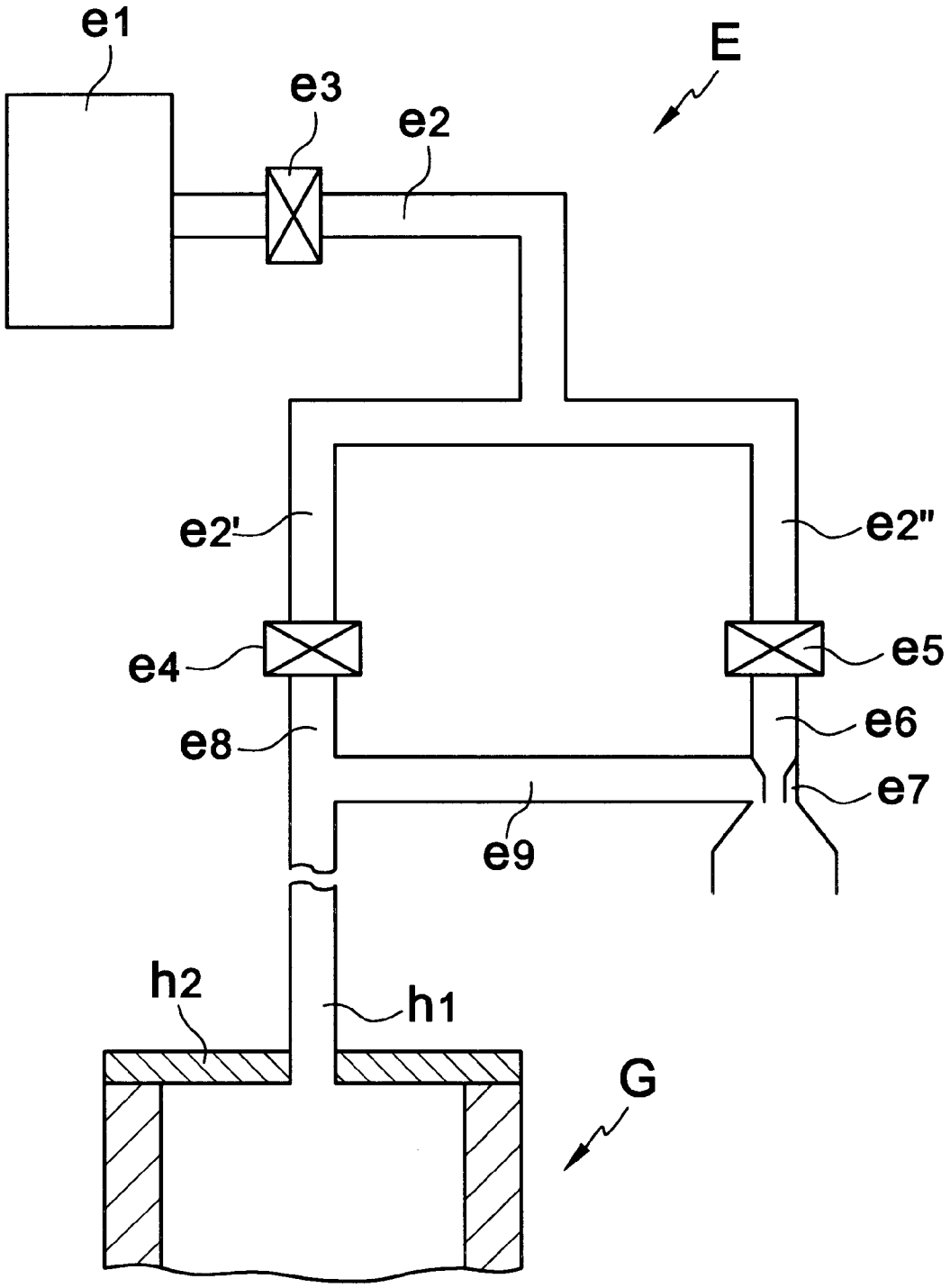
FIG. 2 is an embodiment of the device for generating a low and high air pressure used in the present invention.
Figure 3A:
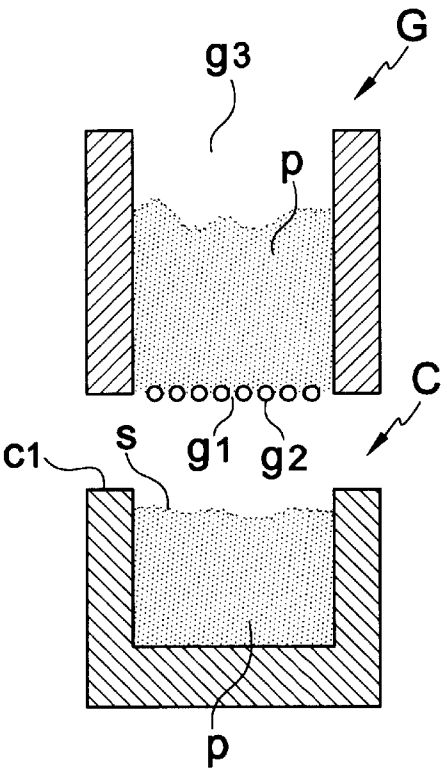
FIGS. 3*a*–3*d* are a vertical cross-sectional view of a part of an apparatus including a feeding hopper by which another powder packing method of the present invention is carried out.
Figure 3B:
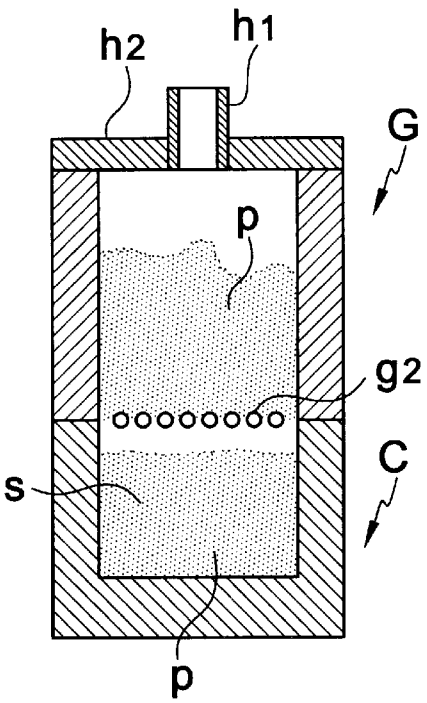
Figure 3C:
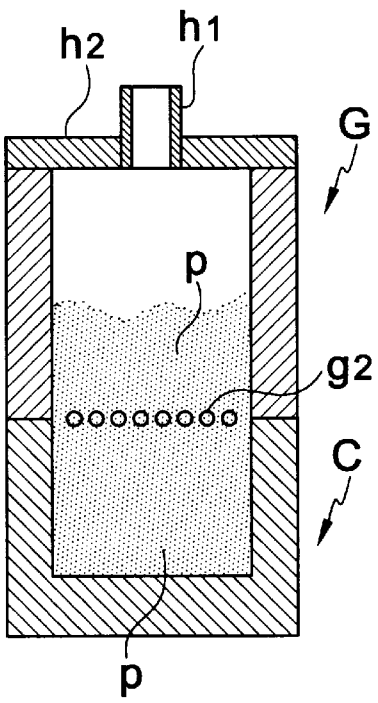
Figure 3D:
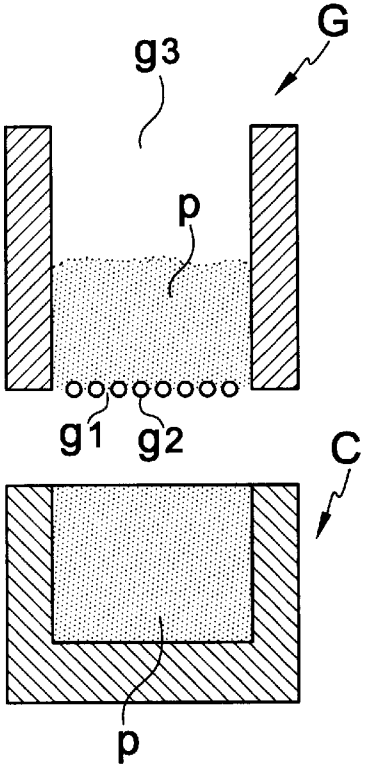

Referring to FIG. 2, the high or low air-pressure generator (hereinafter referred to as the "high/low air-pressure generator") and the air tapping process is described as follows:

Pipe h1 for evacuating and introducing air (hereinafter referred to as "air evacuating/introduction pipe") is provided in a cover device h2 for covering the upper opening g3 of the feeding hopper G, and is connected with the high/low air-pressure generator E. In this embodiment, the high-low air-pressure generator E includes an air source e1, a pipe e2 connected with the air source e1, main valve e3 provided in the pipe e2, n forked pipe consisting of e2' and e2", first valve e4 provided in the pipe e2', second valve e5 provided in the pipe e2", aspirator e7 connected to pipe e6 connected with second valve e5, pipe e9 connected to aspirator e7 and to pipe e8 connected with first valve e4. Air evacuation/introduction pipe h1 provided in cover device h2 is connected to first valve e4 and pipe e9.

In the first step of the air tapping process, as FIG. 1(*b*) shows, feeding hopper D loaded with a material is mounted on the top of container C so that the space of container c and feeding hopper G are connected, and cover device h2 provided with air evacuation/introduction pipe h1 is placed upon the upper opening of feeding hopper G. Then, main valve e3 provided in pipe e2 is opened with first valve e4 closed and second valve e5 opened, when the compressed air from the air source e1 becomes a high speed air flow and go through the pipe e2, the pipe e2', the second pipe e5 and the pipe e6 to be exhausted from the aspirator e7. By this air exhaustion, the inside of the pipe e9 connected to the aspirator e7, as well as inside the pipe e8 are brought to a low-air-pressure state. Thus, the air inside the feeding hopper G covered with the cover device h2 provided with the air evacuation/introduction pipe hi, and the inside of the feeding hopper G assumes low-air-pressure state.

Subsequently, the first valve e4 is opened and second valve e5 is closed while the main valve e3 is being opened, compressed air from the air source e1 flows through the pipe e2, the pipe e2', the first valve e4, the pipe e8 and the air evacuation/introduction pipe h1 into the feeding hopper G, bringing the inside of the feeding hopper G into a high-air-pressure state. Or, it is possible to bring the inside of the feeding hopper G into a high-air-pressure state also by opening the first valve e4 without closing the second valve e5, and simply closing the main valve e3 provided in the pipe e2 connected to the air source e1 so that the air is introduced in the feeding hopper G through the aspirator e7, connecting pipe e9, the pipe e8 and air evacuation/introduction pipe h1. By taking the means as described above in which the second valve e5 is closed and at the same time the first valve e4 is opened, while the main valve e3 provided in the pipe e2 is opened, the inside of the feeding hopper G can be brought to a high-air-pressure state in shorter time. This means makes it possible to increase the speed of the air flow at the air introduction in the feeding hopper G, thereby giving the material in the container C a high packing density.

As discussed so far, the inside of the feeding hopper G covered with the cover device h2 comprising the air evacuation/introduction pipe h1 is brought into a low or high-air-pressure state by using the high/low air pressure generator E, and as a result, the material p is filled into the container C through the grid element g2.

In the air tapping process, the conditions such as the number of cycles of switching from a low-air-pressure state to a high-air-pressure state, the degree of pressure when it is in a low-pressure state or a high-air-pressure-state and low pressure state, the speed of the air flow when introduced in the feeding hopper G are adjusted taking account of the quantity and average particle size of the material, and addition of lubricant, i.e., the flowability of material. The size of the grid is also determined by these elements.

In the present example, the material packing process is carried out so that the material exists both in the space of the container s and the space of the feeding hopper G connected with each other to form a space as a whole. For this purpose, the feeding hopper G is preliminarily loaded with material in a quantity more than the material to be filled into the container, for example, 130% of the material to be packed. In the present example, the air tapping process is repeated as appropriate number of times with the feeding hopper loaded with a material having a quantity more than that to be filled into the space of the space of the container so that the material exists in both in the spaces of the feeding hopper G and the space of the container s after completion of the air tapping. In addition, this example is characterized in that the material remaining in the feeding hopper G after air tapping comprises an upper part of the material that exists both in the feeding hopper G and the space of the container s so that it is uneven in surface contour and thus uneven in density, while the material in the container after air tapping comprises material in the middle and lower part of the material that exists both in the feeding hopper G and the space of the container so that it does not incur bridges, and therefore has a uniform density. As explained above, the feeding hopper is preliminary loaded with material more than that to be filled into the space of the container so that, after air tapping, the middle or lower portion with even surface and density remains in the space of the container s, and the upper portion with uneven surface and density remains in the feeding hopper G. What is important is to ensure that the material in the container is even in surface contour and in density, and the material in the feeding hopper G may have such even part without bridges together with uneven part.

After the container is filled with material p, the main valve e3 provided in the pipe e2 connected to the air source e1 is closed. Subsequently, the cover device h2 is detached from the upper opening g3 of the feeding hopper G which is lifted at the same time. The material is now separated by the grid element g2 into the material p packed in the container with an even density, and the material p remaining in the feeding hopper G. Because the material p has been slightly solidified by this time, it does not drop from the grid element g2 even if the feeding hopper G is separated from the container C. As in the following process, a new container C is set under the feeding hopper G by rotating the indexed turntable which is not shown, and the feeding hopper G is supplied with a material in an amount almost equal to the material packed in the container. After these steps for packing material in the container, the next process is carried out. In the process of powder compaction, the punches are driven to press the packed powder, and a powder compact is obtained.

The following is an explanation of other packing processes of the present invention.

EXAMPLES

In this example, as shown in FIG. 3(*a*), prior to the above mentioned material packing process, the space of the container s is preliminarily filled with a material p in a certain amount, and the feeding hopper is loaded with material p as well. Then, as shown in FIG. 3(*b*), the feeding hopper G is mounted on the top c1 of the container C, and the cover device h2 provided with an air evacuation/introduction pipe h1. Subsequently, the cycle of switching from a low-air-pressure state to a high-air-pressure states described above is repeated several times. If, at this time, the material p is so hard that it is difficult for the material to fall from the feeding hopper G, a magnetic disturbance or mechanical vibration is applied to the vicinity of the lower opening g1 of the feeding hopper G so that the material p is released from the feeding hopper G. This material releasing process is carried out before or during the air tapping process. By the above air tapping, the material p in the feeding hopper G is filled into the space of the container s in the container C through the grid element g2.

After the container is filled with the material p, the main valve e3 provided in the pipe e2 connected to the air source e1 is closed. Subsequently, the cover device h2 is detached from the upper opening g3 of the feeding hopper G which is lifted at the same time as shown in FIG. 3(*d*). The material is now separated by the grid element g2 into the material p packed in the container with an even density, and the material p remaining in the feeding hopper G.

Unlike the example discussed referring to FIG. 1, in the process above in which the container is preliminarily filled with a certain amount of material p, and then, by air tapping, the material p is filled into the remaining space of the space of the container s, because the container has been preliminarily filled with a certain quantity of the material p, it is not necessary for the feeding hopper G to be loaded with the material p in such a quantity as more than that to be packed in the space of the container s. In this example, the quantity of the material p consisting of the material preliminarily packed in the container and the material provided in the feeding hopper G will be sufficient if the material p remains after air tapping in both the feeding hopper G and the space of the container s where there is the material p with a uniform density.

By preliminarily filling the container with a certain amount of the material p, the time for packing is shortened compared to the process in which the material p is packed into a vacant container. Therefore, adoption of this process in an automated apparatus will improve productivity.

In the above described two examples, by providing the lower opening g1 of the feeding hopper G with the grid element g2, the material p is separated into the material p packed in the space of the container s with a uniform density and the material p remaining in the feeding hopper G, as well as the material p in the feeding hopper G is prevented from dropping. It is also possible to provide the lower opening g1 of the feeding hopper G with a thin shutter made of metal or the like so that the shutter prevents the material p from dropping until the feeding hopper G is mounted on the upper end c1 of the container C, and allows the material p to drop into the space of the container s after the feeding hopper G is mounted thereon. In this case, the shutter is closed again after the material p is packed in the space of the container s by air tapping, and then the feeding hopper G is lifted or slid.

Figure 4B:
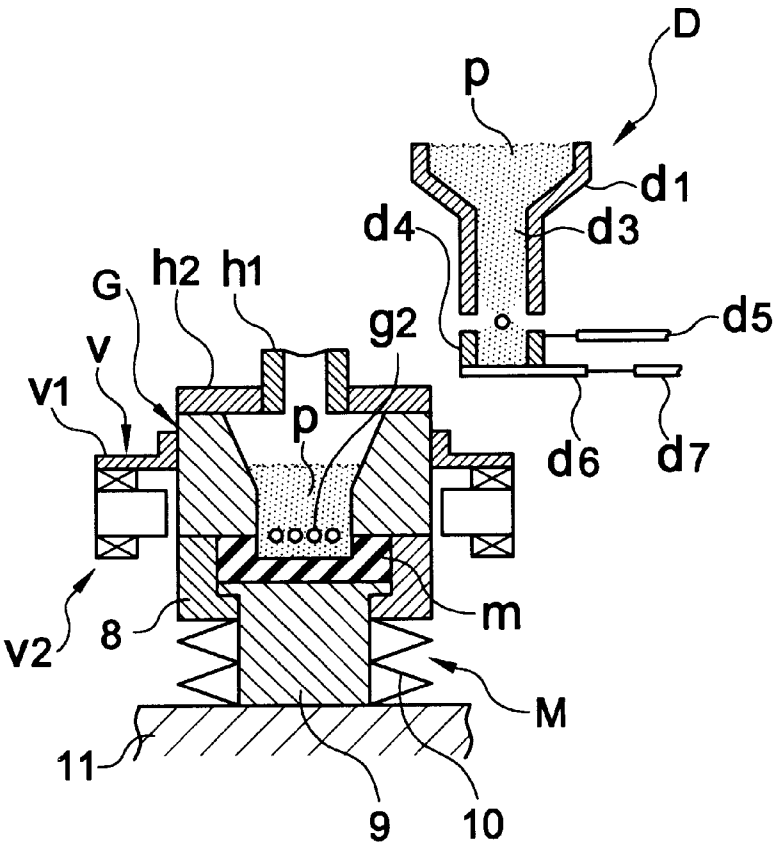
FIGS. 4*a* and 4*b* are a vertical cross-sectional view of a part of an apparatus of the present invention including a die and a feeding hopper illustrating a process of producing a powder compact.
Figure 4A:
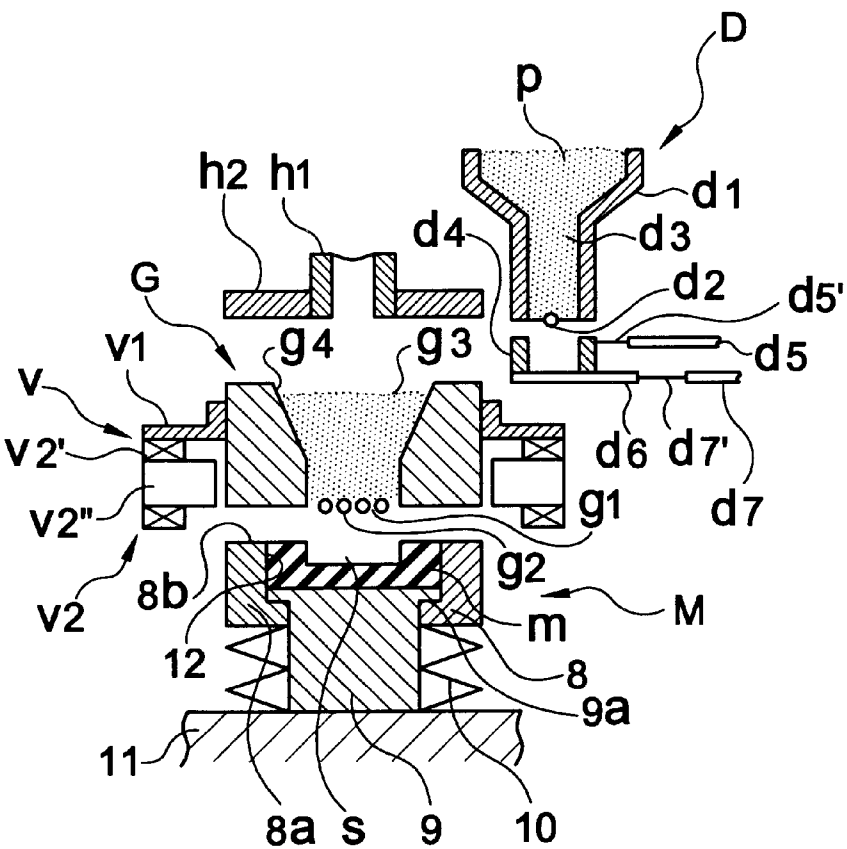
Figure 5B:
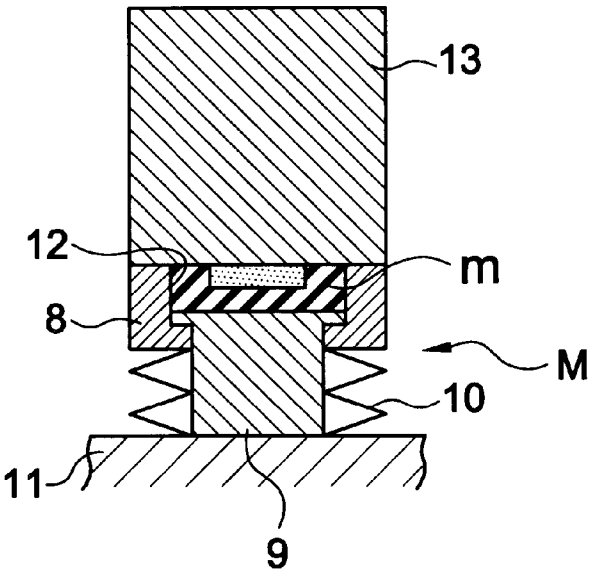
FIGS. 5*a* and 5*b* are a vertical cross-sectional view of the same part as in FIG. 4 illustrating a process following the process in FIG. 4.
Figure 5A:
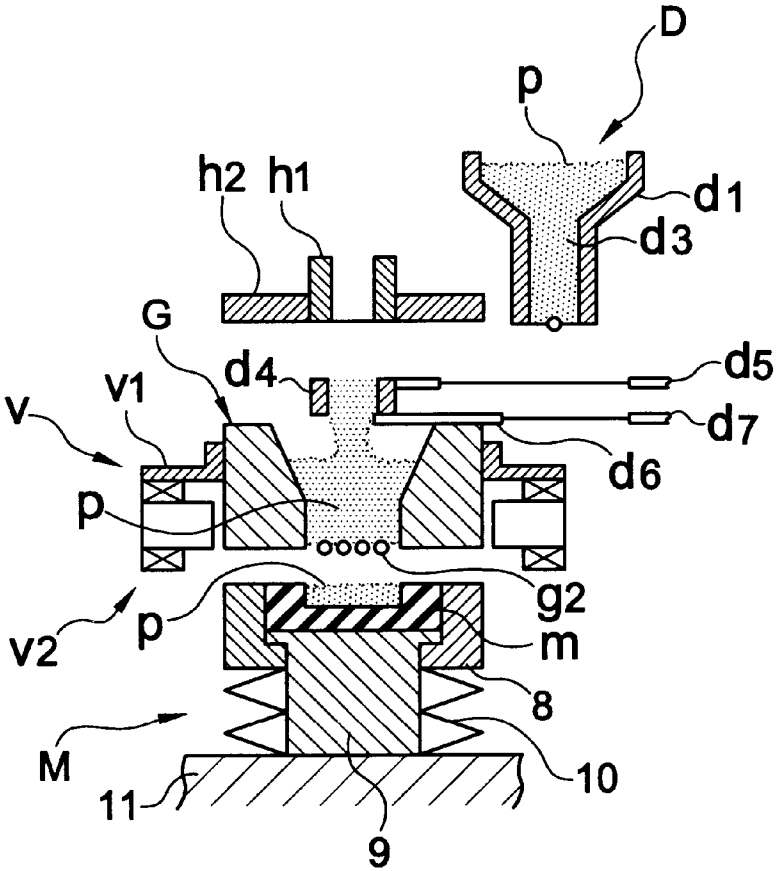

Now referring to FIGS. 4 and 5, another embodiment in which the present invention is applied to the rubber mold isostatic pressing method is discussed. Parts corresponding to those used in the above described examples are denoted by the same numerals.

A lower punch 9 is inserted into cylindrical body 8. Flat springs 10 are provided between the bottom of the cylindrical body 8 and machine base 11 comprising an indexed table or the like. A recess 8*a* is formed in the lower end of the cylindrical body 8 may not move upward and leave the lower punch 9. The cylindrical body 8, lower punch 9 and flat springs 10 constitute a die M. A rubber mold m is provided with a cavity s and set in a space 12 formed by the inside wall of the cylindrical body 8 and the top surface of the lower punch 9. In his embodiment, cavity s has a small depth. A shallow, near-net-shape product such as a thin permanent magnet can be obtained from such a cavity with a small depth. In this example, an experiment for producing a powder compact for the dipolar-type VCM magnet is carried out by using a powder for Nd-FeB magnet, and it is proved that the obtained sintered magnet has a very high $(BH)_{max}$.

Like the previous examples, denoted by G is a feeding hopper mountable on the upper end 8*b* of the cylindrical body 8. The bottom opening g1 of the feeding hopper G is provided with a grid element g2. The upper inside of the feeding hopper G is provided with a slanted part g4 so as to facilitate feeding of powder into the feeding hopper G.

Denoted by D is a powder supplier provided above aside the feeding hopper G, and is provided with a powder-storing hopper d1. The exit 2 of the powder-storing hopper d1 is provided with a means for opening and closing the outlet d2, which means, for example, comprises two flapper valves between which the powder is temporarily held and then dropped from the outlet d2. Denoted by d4 is a cylindrical device for receiving the powder (herein after referred to as the "powder receiver") attached to the end of a piston rod d5' of a horizontal cylinder d5 provided in a machine base not shown in the figure. A shutter d6 for opening and closing the bottom opening of the powder-receiver d4 is attached to a piston rod d7' of a horizontal cylinder d7 provided also in the machine base not shown. The quantity of the material fed into the powder-receiver d4 is almost equal to that to be packed into the cavity s of the rubber mold m.

In a frame v1 attached to the outer wall of the feeding hopper G, a device for agitating powder V is provided which comprises a stator v2 containing a horizontal iron core v2" having a coil v2'. This device is used for filing a magnetic powder such as NdFeB magnet powder, and the function is to release the agglomerated powder being held by the grid element g2 after air tapping so that the powder easily flows through the grid element g2 at the next air tapping. The stator v2 of the device for agitating powder V is connected in the manner of a stator is provided around a rotor of a three-phase synchronous motor or a three-phase induction motor, along the lower outside wall of the feeding hopper G in an appropriate number. By applying a three-phase alternative current to the several stators V2, a rotating magnetic field is generated in the vicinity of or slightly above the grid element g2. If the material is a magnetic powder, such a rotating magnetic field agitates the powder in the vicinity of or slightly above the grid element g2, thereby breaking the agglomerated magnetic powder and making it easily go through the grid element g2. Besides the magnetic agitation, another method for breaking the agglomerated powder is to apply mechanical vibration to the powder with a vibrator attached to the feeding hopper G. The magnetic or mechanic releasing of powder is carried out at each time of air tapping or once in several times of air tapping. If such agglomeration does not occur despite repetition of the powder filling by air tapping, the above powder-releasing process is not necessary.

Now, the process for production of powder compacts is described.

First, as shown in FIG. 4(*a*), the feeding hopper G is mounted on the die M in which the rubber mold is set. The feeding hopper G is loaded with a powder in an amount more than that to be packed in the cavity s, for example, 180% of the powder to be packed. The covering device h2 provided with the air evacuation/introduction pipe h1 connected to the high/low air pressure generator stands by above the feeding hopper G. The opening/closing means d3 for the powder-storing hopper d1 provided in the powder supplying device D is closed. The cylindrical receiver d4 is located under the exit d2 of the powder-storing hopper d1. The bottom opening of the cylindrical receiver d1 is closed with the shutter d6 attached to the end of the piston rod d7' of the horizontal cylinder d7.

Subsequently, as shown in FIG. 4(*b*), the feeding hopper G is mounted on the top 8*b* of the cylindrical body 8. The covering device h2 provided with the air evacuation/introduction pipe h1 connected to the high/low pressure generator E is placed on the top opening g3 of the feeding hopper G. Then, the air inside the feeding hopper G is sucked by the high/low air pressure generator through the air evacuation/introduction pipe h1 so that the inside of the feeding hopper G is brought to a low-air-pressure state. Subsequently, the main valve e3 provided in the pipe e2 of the high/low air-pressure generator is closed, or air is rapidly introduced through the air evacuation/introduction pipe h1 into the feeding hopper G so as to make the inside of the feeding hopper g attach a high-air-pressure state. This cycle is repeated an appropriate number of times during this process, if the powder p becomes agglomerated and hard to flow out of the feeding hopper G, the magnetic or mechanical agitation described above is supplied to the vicinity of the bottom opening g1 of the feeding hopper G so as to break up the agglomeration. This powder-releasing process is carried out before the air tapping process or during the air tapping process. By this air tapping, the powder p provided in the feeding hopper G is packed into the cavity s in the rubber mold m through the grid element g2. While the powder is packed into the container, the opening/closing device d3 for the storing h upper d1 is opened so as to fill the powder-receiver d4 with the powder p.

After the container is filled with the powder p, the main valve e3 provided in the pipe e2 connected to the air source e1 is closed. Subsequently, the cover device h2 is detached from the upper opening g3 of the feeding hopper G which is lifted at the same time. The powder is now separated by the grid element g2 into the powder p packed in the container at an even density, and the powder p remaining in the feeding hopper G. At this time, the powder does not fall from the grid element g2. Subsequently, the horizontal cylinder d5 and the horizontal cylinder d7 are driven so that the powder-receiver d4 filled with powder is lifted above the feeding hopper G with the shutter d6 closed. Then the horizontal cylinder d7 is driven to make the position rod d7' recede so that the shutter d6 is drawn from the bottom opening of the powder-receiver d4 to supply the feeding hopper G with another fill of the powder p, because in the feeding hopper G the powder has been reduced due to the first packing of powder into the cavity of the rubber mold m. After that, the horizontal cylinders d5 and d7 are driven to set the powder-receiver d4 back beneath the exit d2 of the storing hopper d1, as well as the bottom opening of the powder-receiver d4 is closed with the shutter d6. Through the above-described processes, the powder packing into the cavity s of the rubber mold m that is set into the space 12 formed by the inside wall of the cylindrical body 8 of the die M and the upper surface of the lower punch 9 is completed. At this time, the powder in the feeding hopper G hardens and is held on the grid element g2. If the powder is too solidified, it may impede the powder packing by not falling through the grid element g2 into the container at the next air tapping. In such a case, as FIG. 4(*b*) shows, a means for vibrating the feeding hopper G not shown in the Figure is contacted with the feeding hopper G mounted upon the top 8*b* of the cylindrical body 8 so that it provides vibration to break up the powder agglomeration. If the powder is a magnetic powder, by supplying several stators V2 of the device for agitating the powder V with three-phase alternative current, a rotating magnetic field is generated in the vicinity of the grid element g2 so that it agitates the magnetic powder near the grid element g2, and breaks the agglomeration. Such a powder-releasing process by a device for agitating powder V may be carried out before, during, or after the air tapping process only if it is after the feeding hopper has been mounted on the top of the cylindrical body 8. This powder-releasing process with the use of the device for agitating powder should preferably be carried out during the air tapping process because it promotes the filling of the powder into the cavity s with a high density.

After the powder packing processing is finished, as shown in FIG. 5(*b*), the upper punch 13 is mounted upon the top end 8*b* of the cylindrical body 8 and brought down. Then the cylindrical body 8 descends together with the upper punch 13 resisting the force of the flat springs 10. Despite the descent of the upper punch 13 and the cylindrical body 8, the lower punch 9 does not move because it is fixed to the machine base 11 comprising an indexed table. Therefore, the volume of the space 12 formed by the inside wall of the cylindrical body 8 and the top surface of the lower punch 9 is reduced, thereby compressing the powder p packed in the rubber mold m set in the above space 12. After the pressing, the upper punch 18 is lifted and a powder compact is taken out from the rubber mold m.

In the above example, an experiment for producing a compact for dipolar-type VCM thin magnets used for 3.5 inch HDD was carried out using a powder for NdFeB sintered magnets and the pressing was carried out by RIP in which the compact with the desired shape was directly obtained. The depths of the rubber mold cavities were 8 mm and 5 mm. To directly obtain the desired VCM thin compact, the feeding hopper to feed the rubber mold cavity with the NdFeB powder was provided with a grid element fabricated with a 0.3 inch diameter and 30 mm long metal wire formed as a grid, 2 mm in size. The weight of the powder provided in the feeding hopper was 30 g in average just before it was poured from the feeding hopper into the cavity, i.e., the starting of the air tapping. And the weight was varied in the range of ±5 g due to the fluctuation of the supply from the powder-storing hopper shown in FIG. 4(*a*). In the example of FIG. 4, the air tapping was carried out under the condition that: (1) pressure is decreased from atmospheric pressure to 0.5 atm for 0.5 seconds, (2) pressure is increased from 0.5 atm to atmospheric pressure for 0.01 second, and this cycle was repeated 5 times. After this packing process, the density of the powder packed in the cavity was 3.4 g/cm$^3$, and even throughout the thin cavity. It was realized that compared to the natural packing density which is around 2.1 g/cm$^3$, the packing method of the present invention could give much higher packing density to the powder. After the powder-packing process, pressing was carried out by RIP with a pressure of 0.6 Vcm2. As a result, the average weight of the obtained compacts are 9.2 g when the 3 mm-cavity-rubber mold was used, and 13.1 g when the 5 mm-cavity rubber mold was used.

The pressing test was carried out 20 times for both of the two rubber molds, and the weight of the obtained compact scattered only within ±1% in both cases. The size scattering was also very small: within ±0.7% in the horizontal direction, and within ±0.5% in the vertical direction. The cycle time from the powder feeding to the ejection of the compact was within 5 seconds.

In the above examples explained referring to FIGS. 4 and 5, the rubber mold m is first empty and then filled with powder by air tapping from the feeding hopper G supplied with powder in amount more than that to be packed into the cavity s. However, it is also possible to preliminarily supply the cavity s of the rubber mold m with a desired amount of powder, and then carry out the air tapping through the feeding hopper G so as to fill the remaining space of the space of the cavity s with the powder p.

Figure 6B:
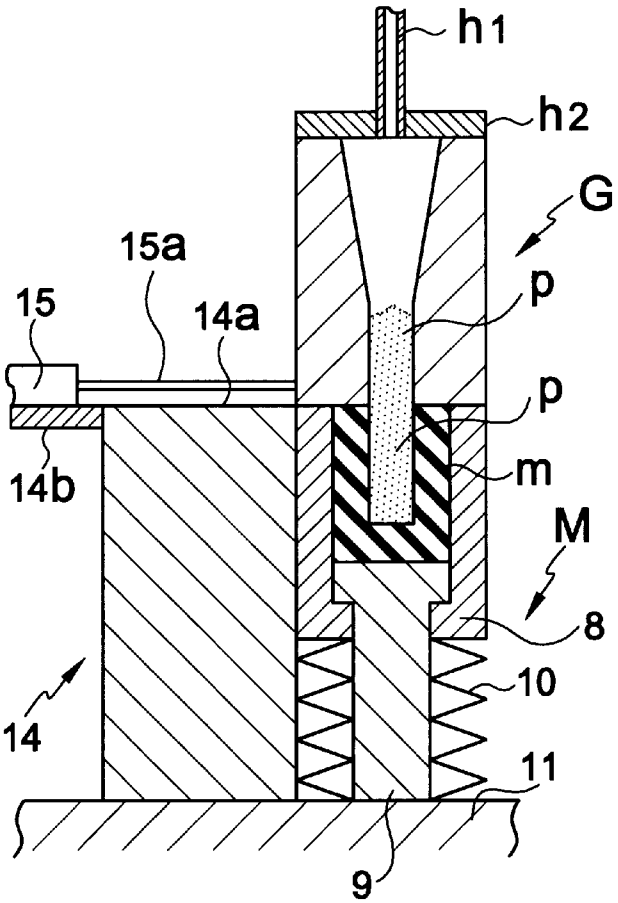
FIGS. 6*a* and 6*b* are a vertical cross-sectional view of a part of another embodiment of the present invention including a die and a feeding hopper illustrating a process of producing a powder compact.
Figure 6A:
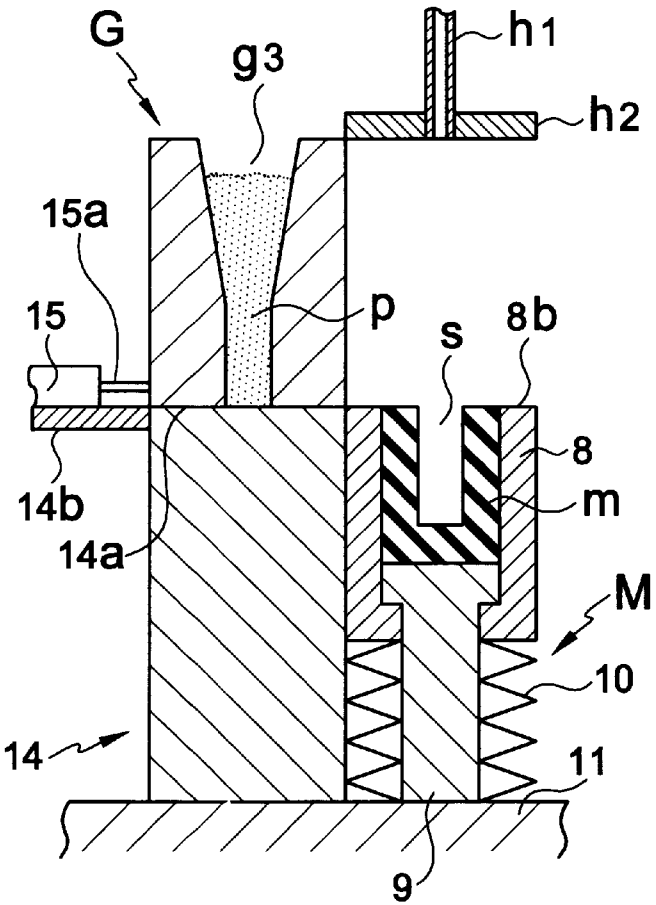

Another example of this invention is hereinafter explained referring to FIG. 6 and FIG. 7. This example also relates to the rubber isostatic pressing method, but in this case, the rubber mold m has a deep cavity s and the bottom opening of the feeding hopper G is not provided with a grid element. The parts corresponding to those in the previous examples are denoted by the same numerals.

Denoted by 14 is a device on which the feeding hopper G is mounted (hereinafter referred to as the "hopper table 14") whose upper surface is flush with the top surface 8*b* of the cylindrical body 8 in which the rubber mold m is set, and is located adjacent to the die M. A horizontal frame 14*b* attached to the hopper table 14 is provided with a horizontal cylinder 15 of which piston rod 15*a* is connected to the feeding hopper G mounted on the hopper table 14. The cover device h2 provided with the air evacuation/introduction pipe h1 connected with the high/low air-pressure generator is located above the die M.

Now, the process for producing a powder compact using the above apparatus is described.

First, the feeding hopper G is mounted upon the hopper table 14, with its inside filled with powder in an amount more than that to be packed into the cavity s of the rubber mold m, for example, 180% or more of that to be packed.

The cover device h2 provided with the air evacuation/introduction pipe h1 stands by above the die M.

The location being as above, the horizontal cylinder 15 is driven to advance the piston rod 15*a* so that the feeding hopper G is placed on the die M, as well as covered with the cover device h2 comprising the air evacuation/introduction pipe h1 connected to the high/low air-pressure generator through the air evacuation/introduction pipe h1 so that the inside of the feeding hopper G is brought to a low-air-pressure state. Subsequently, the main valve e3 provided in the pipe e2 of the high/low air-pressure generator is closed, or air is rapidly introduced through the air evacuation/introduction pipe h1 into the feeding hopper G so as to make the inside of the feeding hopper G a high-air-pressure state. This cycle is repeated an appropriate number of times. During this process, if the powder p becomes agglomerated and hard to flow out of the feeding hopper G, magnetic or mechanical agitation as described above is applied to the vicinity of the bottom opening g1 of the feeding hopper G so as to break up the agglomeration. Through the process described above, the powder in the feeding hopper G is packed into the cavity s of the rubber mold m.

Figure 7B:
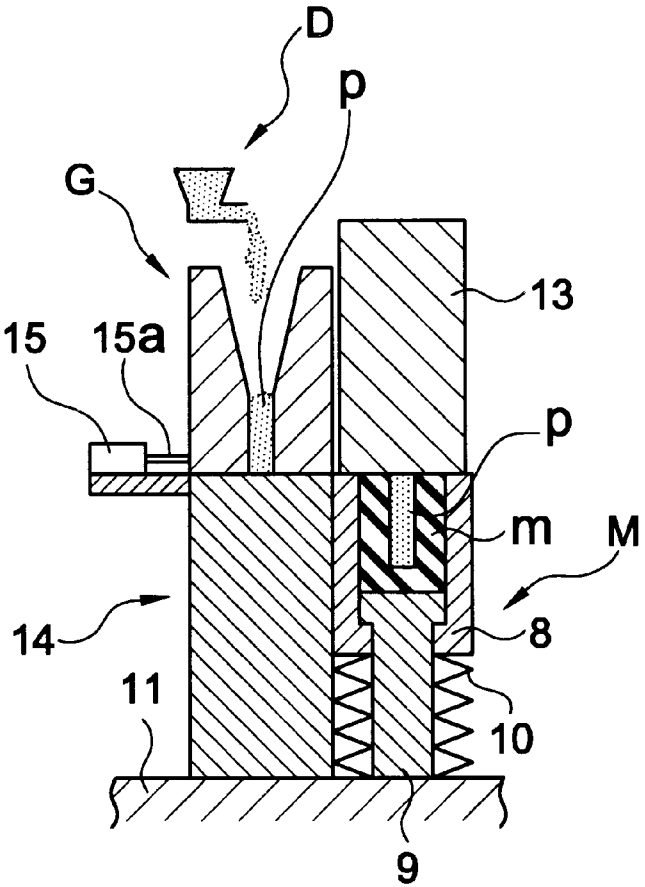
FIGS. 7*a* and 7*b* are a vertical cross-sectional view of the same part as in FIG. 6 illustrating a process following the process in FIG. 6.
Figure 7A:
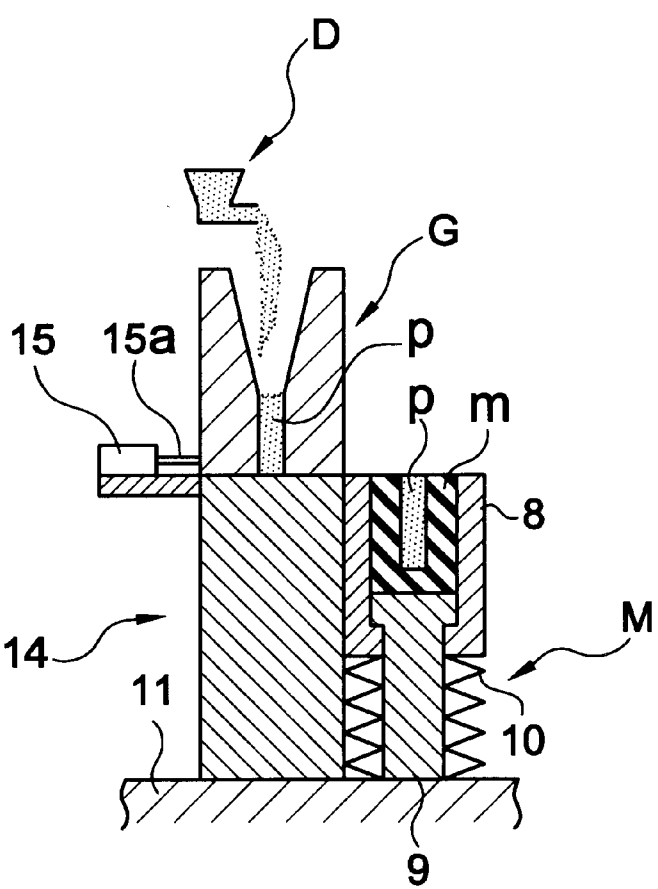

After the powder is packed into the powder-packing cavity s of the rubber mold m, the main valve e3 provided in the pipe e2 of the high/low air-pressure generator E is closed, and the horizontal cylinder 15 is driven to make the piston rod 15*a* recede so that the feeding hopper G is returned on to the hopper table 14 as shown in FIG. 7(*a*). While the feeding hopper G is on its way to returning to the hopper table, the powder p filling the cavity s is leveled at the top surface, and at the same time, the powder p is separated into the powder p filling the container and that remaining in the feeding hopper G. Then, the cover device h2 is detached from the top opening of the feeding hopper G, and another amount of the powder p almost equal in quantity to the powder p that has been packed into the cavity s is supplied into the feeding hopper G. After completion of this powder-packing process, as shown in FIG. 7(*b*), the upper punch 18 is placed upon the top end 8*b* of the cylindrical boy 8, and moved down to compress the powder p packed in the cavity s of the rubber mold m, thereby obtaining a powder compact.

Also in this example, a NdFeB powder with average particle size of 4 $\mu$m was used. The cavity was a columnar cavity with 23 mm in diameter, 60 mm in depth. The feeding hopper was loaded with the powder 180 g±10 g in weight at the stage shown in FIG. 6(*a*). The air tapping was carried out by (1) decreasing the pressure from atmospheric pressure to 0.7 atm for 0.25 second, (2) increasing the pressure from 0.7 atm to atmospheric pressure for 0.005 second, and this cycle was carried out 10 times to fill the columnar cavity with the powder. The packing-density of the powder after the air tapping was 3.4 g/cm$^3$ which was much higher than the packing density of 2.1 g/cm$^3$ when the powder naturally falls into the cavity. Subsequently, the powder was pressed by RIP at a pressure of 0.6 t/cm2. After twenty times of the pressing tests, the weight of the obtained compact was 84.5±1 g, and the average density of the compact was 3.4 g/cm3. It proved that by the method shown in FIGS. 6 and 7, packing with little scattering of weight and high packing-density was possible. However, in the process of leveling shown in FIG. 7(*a*), the powder in the upper part of the cavity was found to be a little slanted. As a result, the surface of the resultant compact was slightly slanted. However, it was realized that such an unevenness of the surface could be remedied by adjusting the condition of leveling to a degree of 0.2 mm different in height. Because the highly and uniformly densified packing can be carried out by this invention, compacts after pressing by RIP had almost no distortion, that is, the diameter of the columnar compact was uniform from the top to the bottom having an average of 20.7 mm, and a tolerance within ±0.1 mm.

In this case, also it is possible to preliminarily supply the cavity with a certain amount of powder, and then, by air tapping through the feeding hopper G, fill the rest of the spaces of the cavity with powder.

Another example in which the powder is compacted by die pressing is now described referring to FIG. 8. Also in this example, the same parts are denoted by the same numerals.

In this embodiment, powder is packed directly into the space 12 formed by the inside wall of the cylindrical body 8 and the top surface of the lower punch 9 inserted into said cylindrical body 8. As in the examples in FIGS. 6 and 7, the bottom opening g1 of the feeding hopper G is provided with a grid element g2. To the top of the feeding hopper G, a cover device comprising an air evacuation/introduction pipe h1 connected to a high/low air-pressure generator is attached in a detachable manner. An appropriate sealing element is provided between the cylindrical body 8 and the lower punch 9 so as to prevent air from leaking from the clearance between them.

When powder is packed into the space 12 formed by the inside wall of the die and the top surface of the lower punch 9, first, the feeding hopper G is mounted upon the cylindrical body 8. The feeding hopper G is loaded, as previously mentioned, with a powder in an amount more than that to be packed into the cavity s, e.g., 180% or more of that to be packed. Then, the air inside the feeding hopper G is sucked by the high/low air-pressure generator through the air evacuation/introduction pipe h1 so that the inside of the feeding hopper G is brought to a low-air-pressure state. Subsequently, the main valve e3 provided in the pipe e2 of the high/low air-pressure generator is closed, or air is rapidly introduced through the air evacuation/introduction pipe h1 into the feeding hopper G so as to make the inside of the feeding hopper G attain a high-air-pressure state. This cycle is repeated an appropriate number of times. During this process, if the powder p becomes agglomerated and hard to flow out of the feeding hopper G, the magnetic or mechanical agitation described above is applied to the vicinity of the bottom opening g1 of the feeding hopper G so as to break up the agglomeration. Such an agitation for releasing the agglomerated powder is carried out before or during the air tapping process. Through the process described above, the powder in the feeding hopper G is packed into the cavity s of the rubber mold m.

Figure 8D:
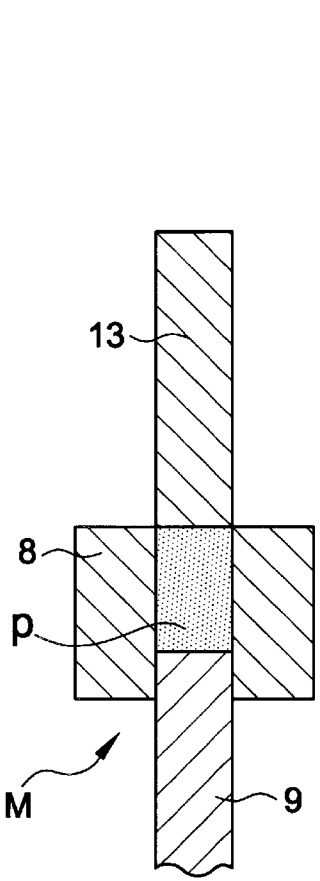
FIGS. 8*a*–8*d* are a vertical cross-sectional view of a part of another embodiment of the present invention including a die and a feeding hopper illustrating a process of producing a powder compact.
Figure 8C:
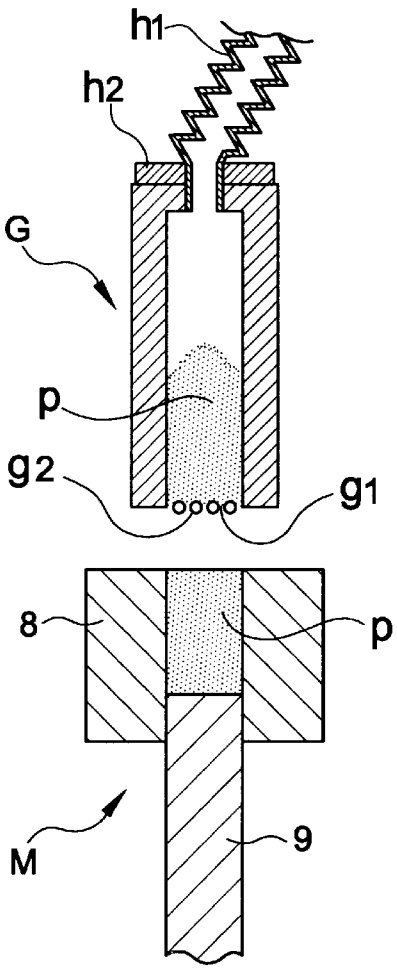
Figure 8B:
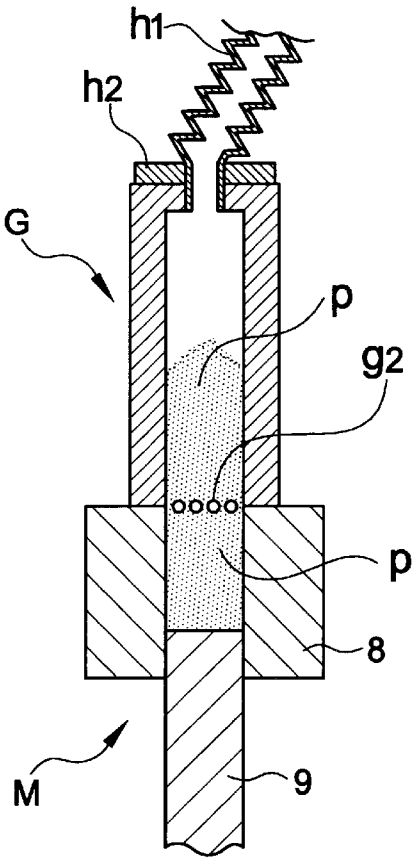
Figure 8A:
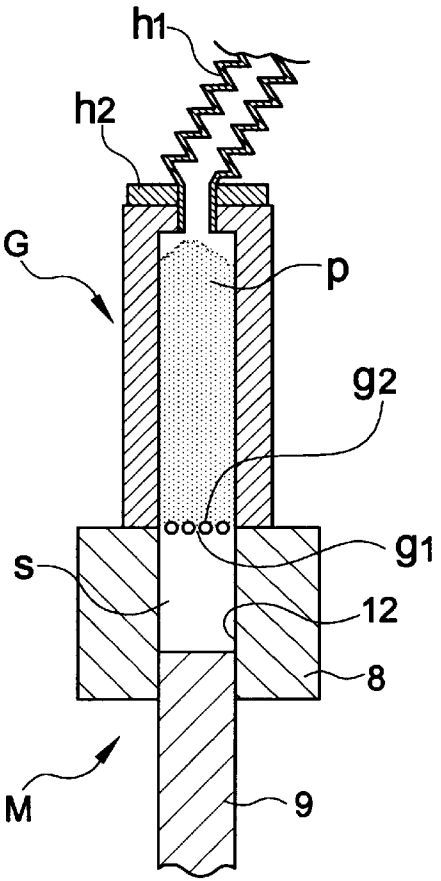

After the powder is packed into the power-packing cavity s of the rubber mold m, the main valve e3 provided in the pipe e2 of the high/low air-pressure generator E is closed, as well as the feeding hopper G is lifted as shown in FIG. 8*c*. The powder p is divided by the grid element g2 into the powder packed evenly into the cavity s and the powder remaining in the feeding hopper G. As already mentioned, the powder p is held by the grid element g2 and does not fall from the feeding hopper G. Subsequently, the feeding hopper G is moved aside and, as FIG. 8(*d*) illustrates, the upper punch 13 is inserted into the cylindrical body 8, and the powder p is compressed with the upper punch 13 and the lower punch 9. The feeding hopper G after feeding the powder into the cavity is to be supplied with additional powder in good time.

In this example, SUS430 stainless steel powder was used. The powder was an atomized powder having an average particle size of 12 μm. The die cavity had a diameter of 25 mm and the depth was adjusted to be 20 mm by controlling the lower punch. The quantity of the powder supplied from the powder-storing hopper was controlled so that the powder in the feeding hopper at the stage shown in FIG. 8(*a*). The opening of the feeding hopper was provided with a grid element formed with metal needles 0.3 mm in diameter aligned at a distance of 4 mm. The air tapping was carried out by (1) decreasing the pressure from atmospheric pressure to 0.3 atm for 0.5 second, (2) increasing the pressure from 0.3 atm to atmospheric pressure for 0.01 second, and this cycle was carried out 10 times to fill the columnar cavity with the powder. The packing-density of the powder after the air tapping was 4.52 g/cm$^3$, which was much higher than the packing density of 3.02 g/cm$^3$ when the powder is naturally dropped into the cavity. Subsequently, the powder was pressed by the punches with a pressure of 0.6 t/cm$_2$.

After twenty times of the pressing tests, the weight of the obtained compact was 44.4±1 g in average weight, and scattered within ±0.2 g. It proved that by the method of this invention adopted in die pressing, the packing could be carried out within several seconds, and scattering of weight was very small, and high packing density could be achieved. Therefore, the distance for the punches to travel to press the die could be very small.

Figure 9:
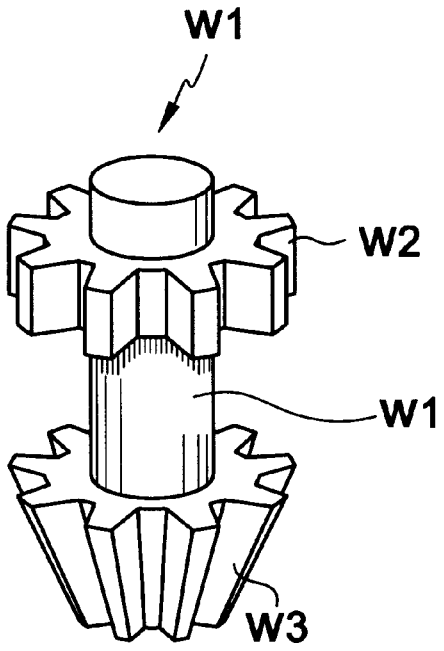
FIG. 9 is a perspective view of an embodiment of the powder compact produced by the apparatus of the present invention.
Figures 10A, 10B, 10C, 10D:
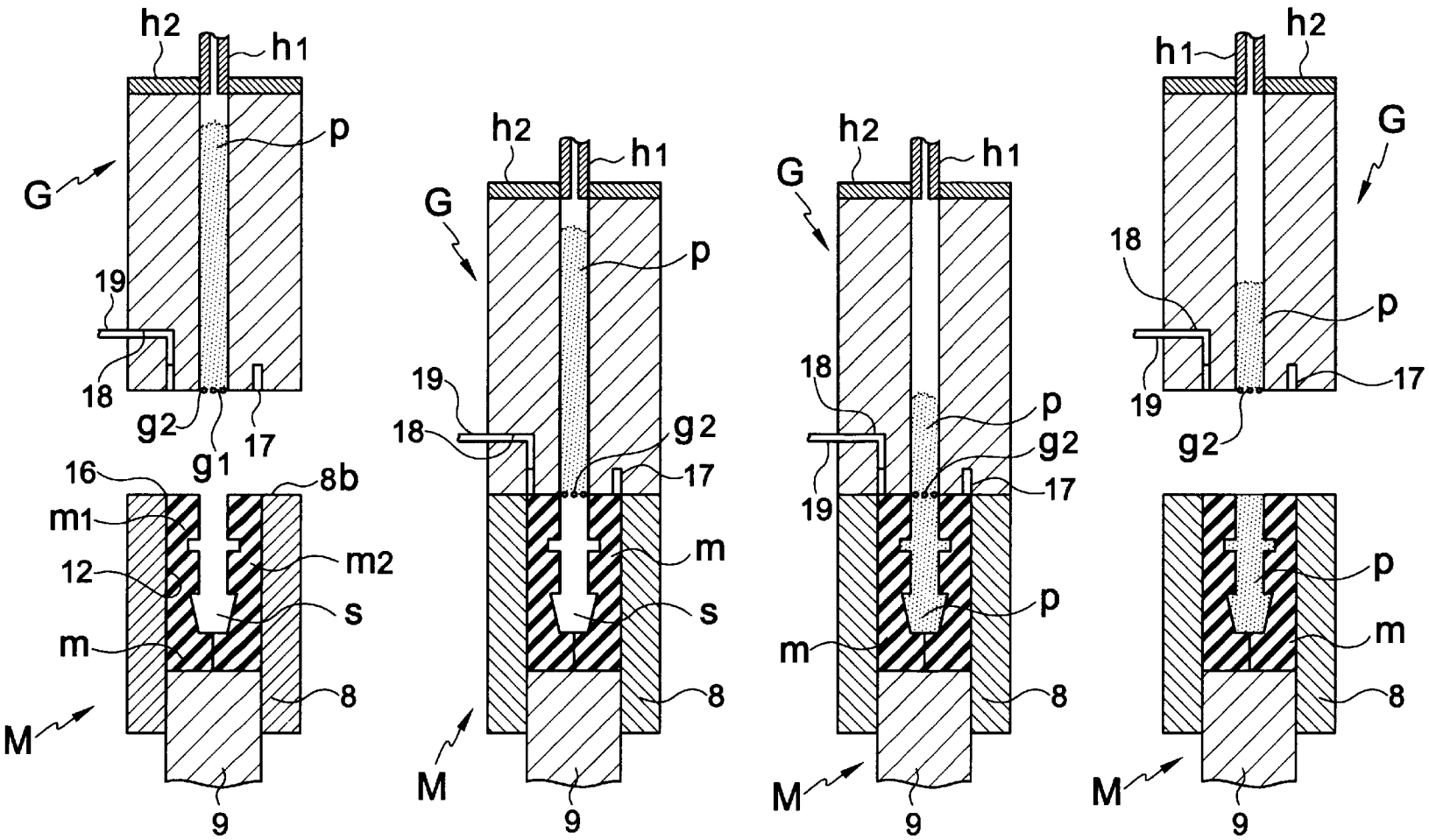
FIGS. 10*a*–10*d* are a vertical cross-sectional view of a part of an apparatus of the present invention including a die and a feeding hopper, illustrating a process of producing a powder compact shown in FIG. 9.
Figure 11C:
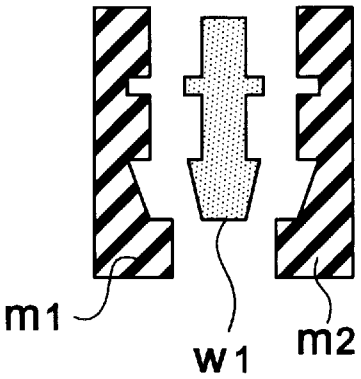
FIGS. 11*a*–11*c* are a vertical cross-sectional view of the same part as in FIG. 10 illustrating a process following the process in FIG. 10.
Figure 11B:
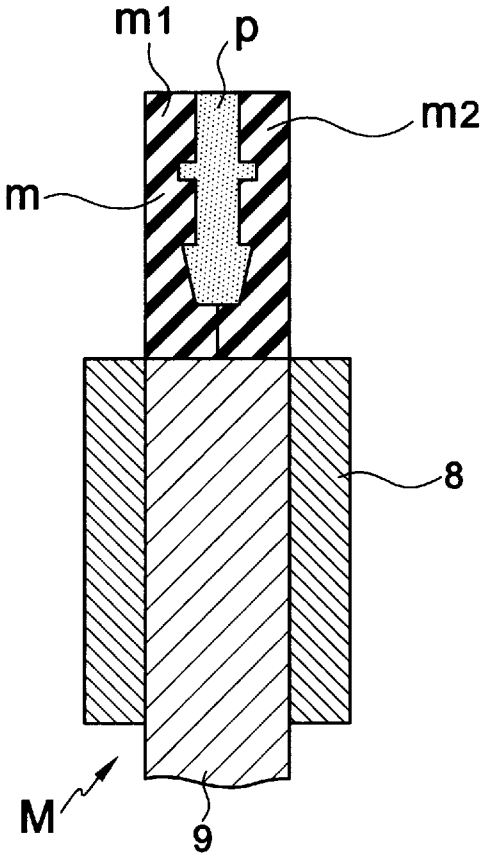
Figure 11A:
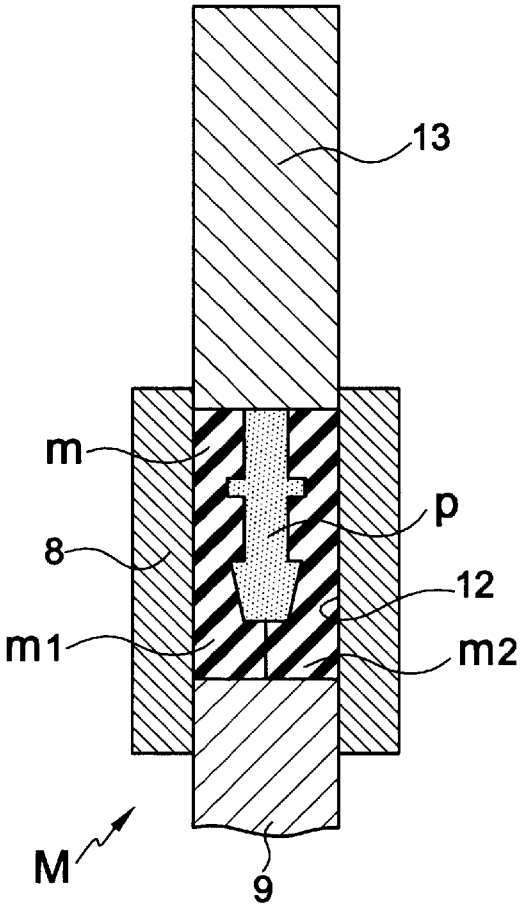

Powder compact W1 shown in FIG. 9 is an embodiment of the powder compact produced by rubber isostatic pressing adopting the present invention. The powder compact W1 forms an integrated body comprising a spur gear w2 which is formed around the middle of axis w1 and a bevel gear w3 formed at the end of axis w1. Referring to FIGS. 10 and 11, another embodiment of the present invention for producing a powder compact as W1 is hereinafter described.

A rubber mold m shaped almost the same as the compact W1 is set in the space 12 formed by the inside wall of a cylindrical body 8, and a lower punch 9 is inserted therein. The rubber mold consists of vertically separated two parts, m1 and m2, to that the powder compact W1 after pressing can be taken out from the rubber mold m.

The bottom opening g1 of the feeding hopper G is provided with a grid element g2. The feeding hopper G is loaded with a powder in an amount more (e.g. 130% or more) than that to be packed into the cavity s, and covered with a cover device h2 comprising an air evacuation/introduction pipe h1 connected to a high/low air-pressure generator. The bottom of the feeding hopper G is provided with an annular air chamber 17 so that it covers the contact line of the cylindrical body 8 and rubber mold m. The feeding hopper G is also provided with a pipe 18 connecting to the annular air chamber 17. The pipe 18 is connected with an air source not shown in the figure.

The packing process of this embodiment of the invention is now explained. First, as shown in FIG. 10(*a*), the feeding hopper G is mounted upon the die M loaded with the rubber mold m as well as covered with the cover device h2 comprising the air evacuation/introduction pipe h1 connected to the high/low air-pressure generator E. Then the feeding hopper covered with the cover device h2 is mounted on the upper end 8*b* of the cylindrical body 8. Subsequently, the air source (not shown) is actuated so that the air pressure in the annular air chamber 17 is reduced through the pipe 19 and 18, and that the clearance space existing between the rubber mold m and the cylindrical body 8 is brought to a low-air-pressure state.

By bringing the clearance space between the rubber mold m and the cylindrical body 8 to a low-air-pressure state, the rubber mold is firmly fixed to the inner wall of the cylindrical body 8, which prevents the rubber mold m from moving, jolting or deforming during the air tapping. Then, the air inside the feeding hopper G is sucked by the high/low air-pressure generator through the air evacuation/introduction pipe h1 so that the inside of the feeding hopper G is brought to a low-air-pressure state. Subsequently, the main valve e3 provided in the pipe e2 of the high/low air-pressure generator is closed, or air is rapidly introduced through the air evacuation/introduction pipe h1 into the feeding hopper G so as to make the inside of the feeding hopper G a high-air-pressure state. This cycle is repeated an appropriate number of times. During this process, if the powder p becomes agglomerated and hard to flow out of the feeding hopper G, the magnetic or mechanical agitation described above is applied to the vicinity of the bottom opening g1 of the feeding hopper G so as to break up the agglomeration. Through the process described above, the powder in the feeding hopper G is packed into the cavity s of the rubber mold m. After the cavity s is filled with the powder, the main valve e3 provided in the pipe e2 of the high/low air-pressure generator is closed.

Subsequently, the air evacuation is stopped so as to release the inside of the annular air chamber 17 from the low-air-pressure state, and the feeding hopper G covered with the cover device h2 is lifted as shown in FIG. 10(*d*). The powder is now divided by the grid element g2 into the powder p packed in the container with an even density, and the powder p remaining the in the feeding hopper G. At this time, the powder does not fall from the grid element g2. Subsequently, the cover device h2 is detached, and the feeding hopper G is supplied with additional powder.

Next, as shown in FIG. 11(*a*), the upper punch 13 is inserted into the cylindrical body 8 so that the rubber mold m filled with the powder p is compressed between the upper punch 13 and the lower punch 9. Then the upper punch is moved upward and the lower punch 9 is lifted as shown in FIG. 11(*b*) so as to take the rubber mold m filled with the powder p out of the cylindrical body 8. The rubber mold m is then separated into two parts, m1 and m2, and the powder compact w1 shown in FIG. 11(*a*) is taken out.

In this example, the same powder as that used in the example of FIG. 8 was used. Pressing tests for compacting the powder into various shapes such as the compact W in FIG. 9 and other complex shapes were carried out by using RIP. We consider that combining the packing method of this invention with the RIP technique, that we proposed recently, will make it possible to produce parts with complex, three dimensional shapes. In order to obtain such a three dimensional, complex part in near-net-shape, we produced a separated rubber mold as in FIG. 10 with a hard rubber, and chose the conditions enabling the packing density to be as high as possible in the packing method of this invention. That is, urethane rubbers with a Shore hardness of A60, A70, A80 and A90 were used and the air tapping was carried out by (1) decreasing the pressure from atmospheric pressure to 0.3 atm for 0.5 second, (2) increasing the pressure from 0.3 atm to 1.5 atm for 0.05 second, and (3) decreasing the pressure from 1.5 atm to 0.3 atm for 0.6 second, and this cycle was carried out 10 times. After the air tapping, pressing by RIP was carried out with a pressure of 0.8 Vcm$^2$, and then the rubber mold was taken out of the die, and the compact was taken out by separating the rubber mold. We found out that many complex parts could be produced by this method above. In particular, it was verified that the present packing method could distribute the powder to every corner of the rubber mold even if its shape was complex, and that a uniform and high packing density could be obtained, which resulted in success in producing parts with such complex shapes.

It is also possible in this case to preliminarily supply the cavity s of the rubber mold m with a desired amount of powder, and then air tapping is carried out through the feeding hopper G so as to fill the remaining space the cavity s with the powder.

The following is a description of another embodiment of this invention in which a rubber mold having plural cavities is used in RIP. The parts corresponding to the same parts in the above examples are denoted by the same numerals.

Figures 12A, 12B, 12C:
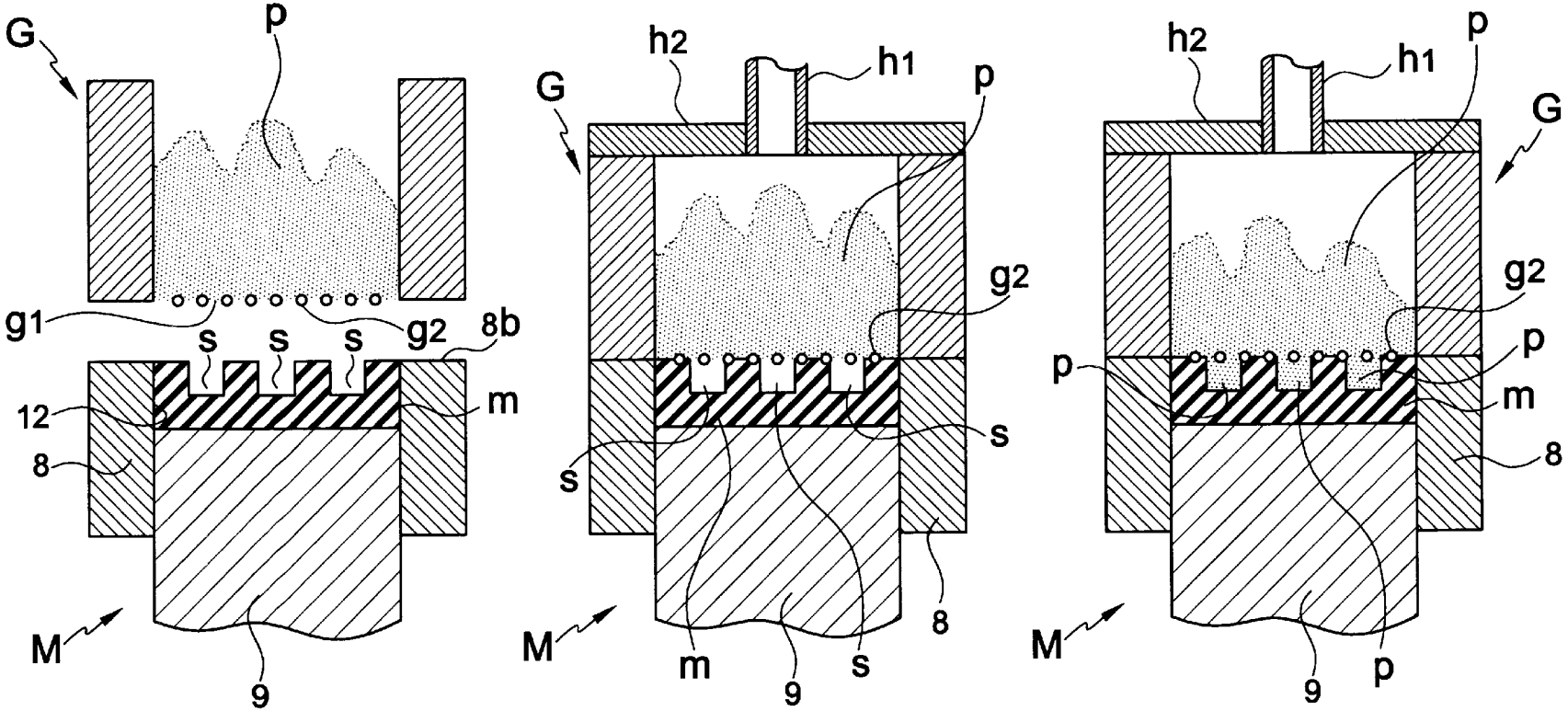
FIGS. 12*a*–12*c* are is a vertical cross-sectional view of a part of another embodiment of the present invention including a die and a feeding hopper illustrating a process of producing a powder compact.

As shown in FIG. 12(*a*), the space 12 formed by a cylindrical body 8 and a punch 9 inserted therein is loaded with a rubber mold m provided with plural cavities s. The feeding hopper G is provided with a grid element g2 at its bottom opening and loaded with powder p in a quantity more than that to be packed in the cavity s (*for example,* 130% or more).

Then, as shown in FIG. 12(*b*), the feeding hopper is mounted upon the cylindrical body 8, and at the same time, covered with a cover device h2 provided with a pipe h1 connected to a high/low air-pressure generator E.

Subsequently, the air inside the feeding hopper G is sucked by the high/low air-pressure generator through the air evacuation/introduction pipe h1 so that the inside of the feeding hopper G is brought to a low-air-pressure state. Subsequently, the main valve e3 provided in the pipe e2 of the high/low air-pressure generator is closed, or air is rapidly introduced through the air evacuation/introduction pipe h1 into the feeding hopper G so as to make the inside of the feeding hopper G attain a high-air-pressure state. This cycle is repeated appropriate times. During this process, if the powder p becomes agglomerated and hard to flow out of the feeding hopper G, the magnetic or mechanical agitation described above is applied to the vicinity of the bottom opening g1 of the feeding hopper G so as to dissolve the agglomeration. Through the process described above, the powder in the feeding hopper G is packed into the cavity s of the rubber mold m. After the cavity s is filled with the powder, the main valve e3 provided in the pipe e2 of the high/low air-pressure generator is closed.

Figure 13B:
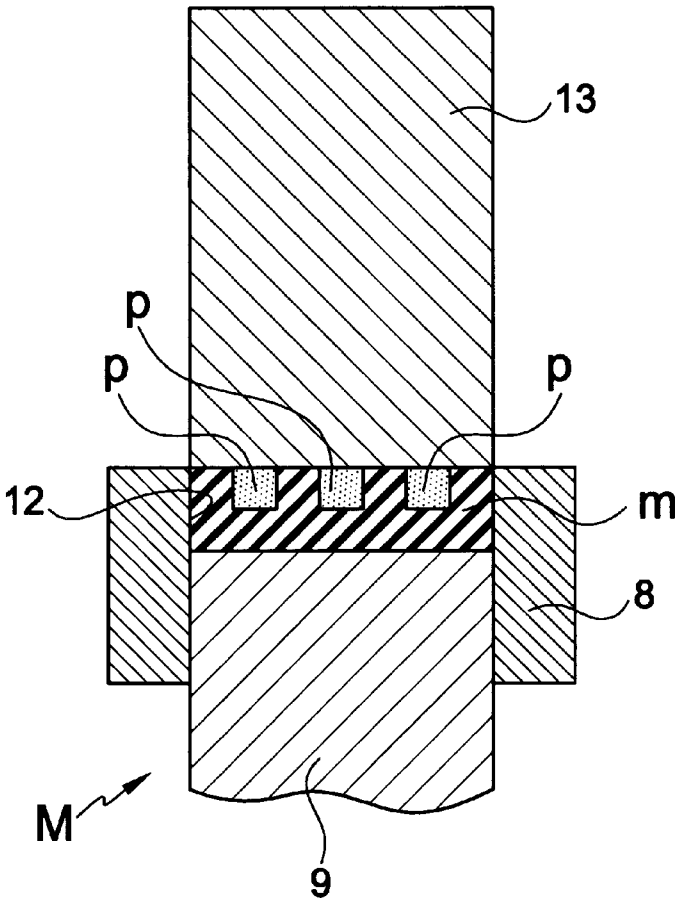
FIGS. 13*a* and 13*b* are a vertical cross-sectional view of the same part as in FIG. 12 illustrating a process following the process shown in FIG. 12.
Figure 13A:
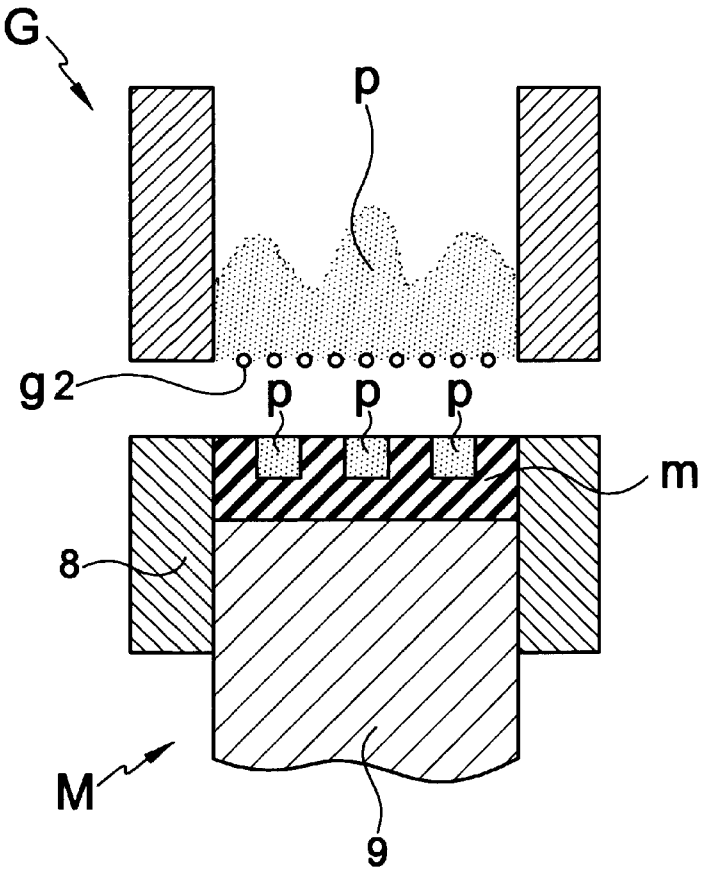

Subsequently, a shown in FIG. 13(*a*), the cover device h2 is detached from top opening g3 of the feeding hopper G, and the feeding hopper G is lifted. Thus, the powder p is divided by the grid element g2 into the powder packed in the cavity s and the powder remaining in the feeding hopper G. As mentioned above, the powder does not fall through the grid element g2. Then, the upper punch 13 is inserted into the cylindrical body 8 as shown in FIG. 13(*b*), and the rubber mold filled with the powder p is compressed between the upper punch 13 and the lower punch 9 so as to obtain a powder compact.

Figure 18B:
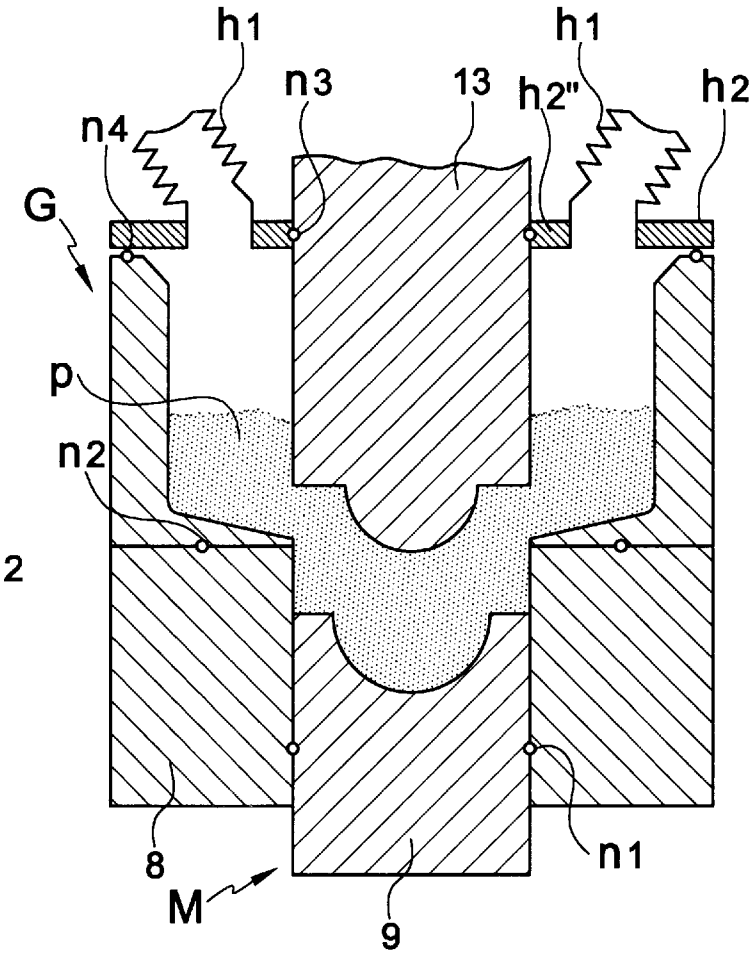
FIGS. 18*a* and 18*b* are a vertical cross-sectional view of a part of an apparatus of the present invention including a die and a feeding hopper illustrating the process of producing a powder compact.
Figure 18A:
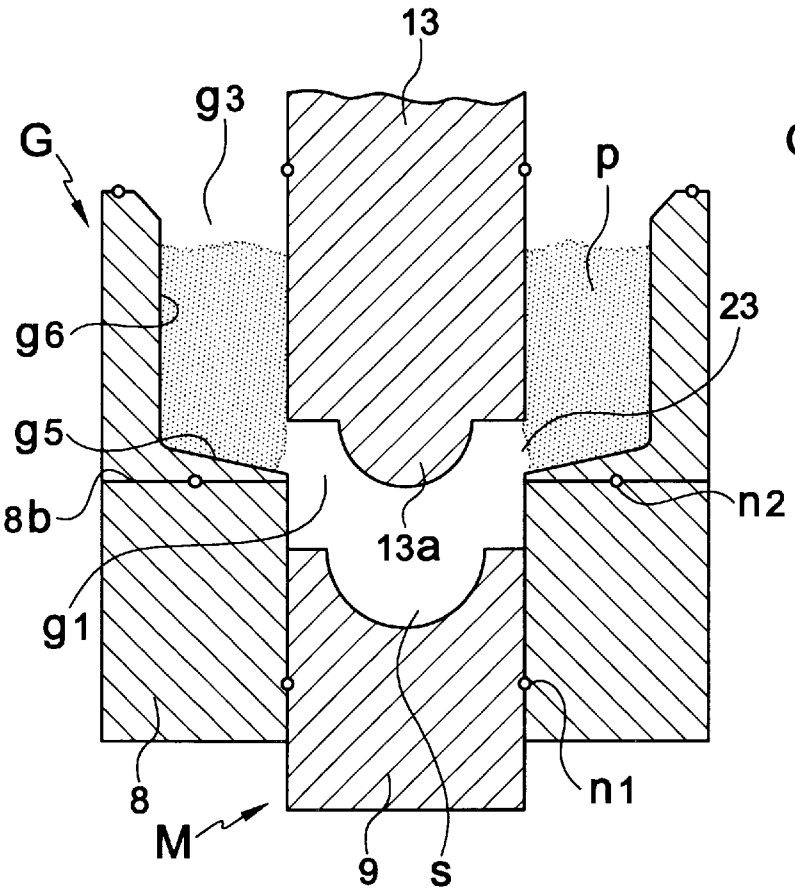

In this example, a powder for NdFeB sintered magnets with an average particle size of 4 $\mu$m was used. The rubber mold was shaped as a disc and was 56 mm in diameter and 14 mm in thickness. The rubber mold was provided with seven cavities shaped as pillars having a 8 mm×8 mm square section and a depth of 7 mm. The bottom opening of the feeding hopper was shaped as a circle having the same size as the rubber mold, and provided with a grid element formed with metal needles with a diameter of 0.5 mm aligned by a distance of 2 mm. The quantity of the powder in the feeding hopper is adjusted to be 40g±10 g before the air tapping process (FIG. 12(*a*)). The structure being as above, the NdFeB powder was packed into the seven cavities through the process shown in FIGS. 12(*b*), 12(*c*), and 12(*a*). The air tapping was carried out by (1) decreasing the pressure from atmospheric pressure to 0.6 atm for 0.4 second, (2) increasing the pressure from 0.6 atm to atmospheric pressure for 0.01 second, and this cycle was carried out 10 times. After twenty repetitions of the RIP pressing tests, the compacts had a weight of 1.52 g±0.05 g, which showed that the scattering of the packed quantity was very small even though plural cavities were packed at the same time. At first, there was a concern that the remaining powder sticking to the surface of the rubber mold caused to impede the pressing in FIG. 18(*b*). However, such trouble never arose in twenty repetitions of pressing. When the process illustrated in FIG. 12 and 18 is carried out by an automated apparatus, continuous production can be done by cleaning the surface of the rubber mold every time or every several times of the pressing.

Figure 27A:
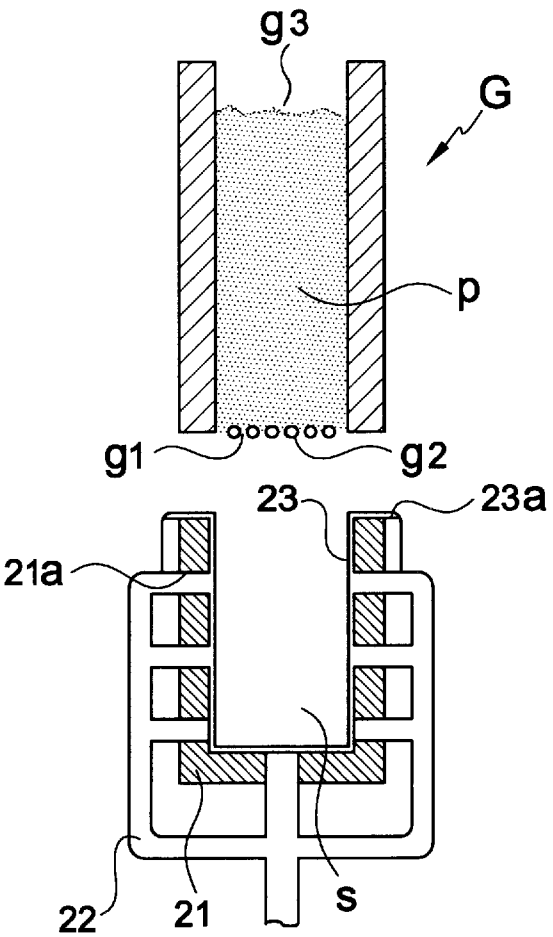
FIGS. 27*a*–27*c* are a vertical cross-sectional view of an embodiment of this invention including a feeding hopper and a bag-holding container.
Figure 27B:
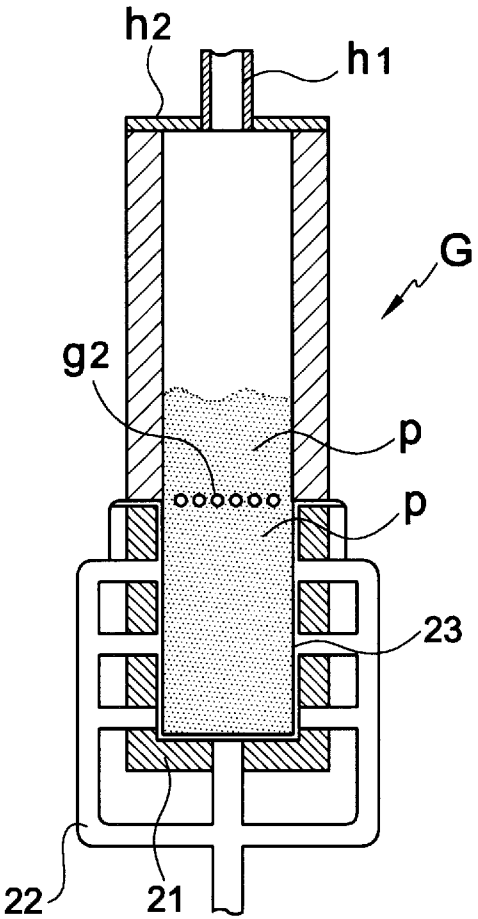
Figure 27C:
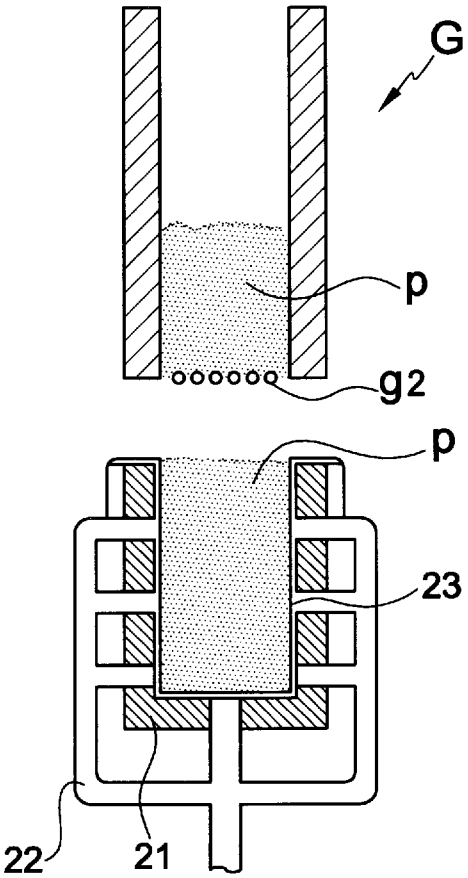
Figure 28A:
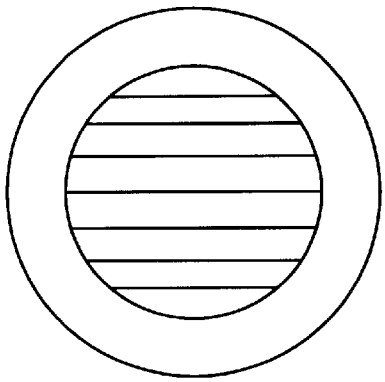
FIGS. 28(A) through 28(E) depicts examples of grids suitable for use in this invention.
Figure 28B:
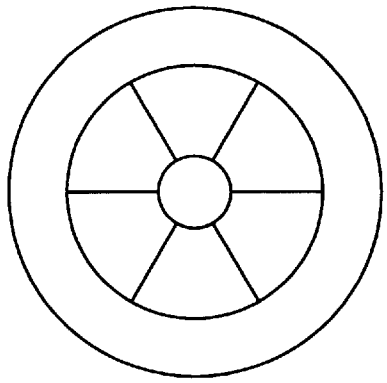
Figure 28C:
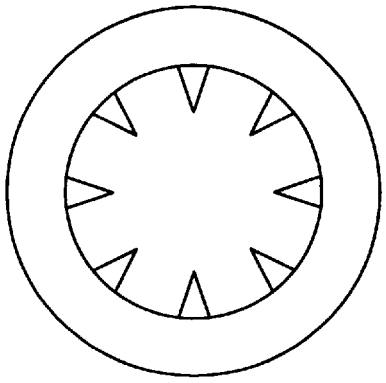
Figure 28D:
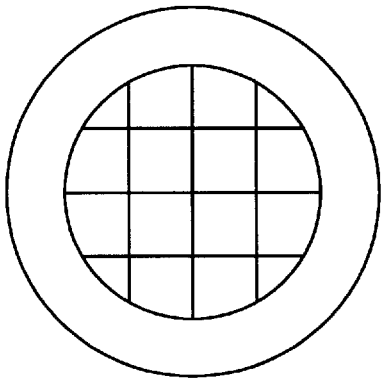
Figure 28E:
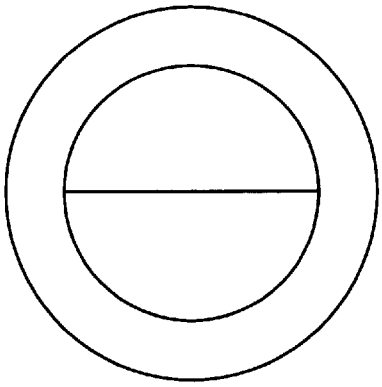

Another embodiment of the present invention in which a material is packed into a bag made of synthetic resin or paper or the like is described in FIG. 27.

A bag-holding container 21 is provided with through holes 21*a* in its side and an opening on the top. To the through holes 21*a,* an air evacuation pipe 22 connected to an air source not shown in the figure is connected. A bag 23 is set inside the bag-holding container 21 with its and 23 being laid on the upper end of the bag-holding container 21. As shown in FIG. 27(*a*), a feeding hopper G loaded with a powder p in a quantity more than (for example, 130% of) that to be packed into the space of the bag is provided with a grid element g2 in its bottom opening (g1), and located above the bag-holding container 21.

When a material is packed into the bag 23 set inside the bag-holding container 21, the air source is actuated to suck the air through the air evacuation pipe 22 so that the bag 23 is attached to the inside of the bag-holding container 21 and held by the same. By attaching the bag 23 to the inside of the bag-holding container 21 as above, the bag is sufficiently swelled, and its movement during air tapping can be restricted. Subsequently, as shown in FIG. 27(*b*), the feeding hopper G is mounted on the bag-holding container 21. The covering device h2 provided with the air evacuation/introduction pipe h1 connected to the high/low pressure generator E is placed on the top opening g3 of the feeding hopper G. Then, the air inside the feeding hopper G is sucked by the high/low air pressure generator through the air evacuation/introduction pipe h1 so that the inside of the feeding hopper G is brought to a low-air-pressure state. Subsequently, the main valve e3 provided in the pipe e2 of the high/low air-pressure generator is closed, or air is rapidly introduced through the air evacuation/introduction pipe h1 into the feeding hopper G so as to make the inside of the feeding hopper G attain a high-air-pressure state. This cycle is repeated an appropriate number of times. Through this air tapping, the material p is packed into the space of the bag 23 through the grid element g2. The main valve e3 provided in the pipe e2 of the high/low-air-pressure generator is closed after the packing the material into the bag-holding container.

After the bag 23 is packed with the material p, the cover device h2 is detached from the top opening of the feeding hopper G, and the feeding hopper G is moved upward. Now, the material has been divided into the material remaining in the feeding hopper G and the material packed with a uniform density into the space of the bag. At this time, as already mentioned, the material held on the grid element does not fall. Subsequently, the air supply is stopped to release the bag 23 from inside the bag-holding container, and the bag 23 packed with the material p is taken out to be subjected to the next process as vacuum packaging.

It is also possible in this case to preliminarily supply the space of the bag 23 with a desired amount of material p, and then air tapping is carried out through the feeding hopper G so as to fill the remaining space in the bag 23 with the material p.

In this example, a polyethylene bag 20 mm in diameter and 20 mm in length was packed with flour and aluminum fiber. The average length and thickness of the aluminum fiber were 20 $\mu$m and 20 nm, respectively. As the feeding hopper, an acrylic pipe with an inside diameter of 20 mm and a length of 100 mm was used. The bottom opening of the acrylic pipe was provided with a grid element formed with metal needles 0.5 mm in diameter aligned in parallel at a distance of 8 mm. The feeding hopper was loaded with the material to the height of 80% at the stage shown in FIG. 27(*a*). The air tapping was carried out when packing flour by (1) decreasing the pressure from atmospheric pressure to 0.4 atm for 0.5 second, (2) increasing the pressure from 0.4 atm to atmospheric pressure for 0.01 second, and this cycle was carried out 10 times. When packing aluminum fiber, the air tapping was carried out by (1) decreasing the pressure from atmospheric pressure to 0.4 atm for 0.7 second, (2) increasing the pressure from 0.4 atm to atmospheric pressure for 0.01 second, and this cycle was carried out 10 times. As a result, the flour was packed into the bag with a density of 0.95 g/cm$^3$, and the aluminum fiber was packed into the bag with a density of 0.74 g/cm$^3$. When these materials were poured into a glass or cup without applying vibration, the density of the packed flour was 0.51 g/cm$^3$, and that of the aluminum fiber was 0.25 g/cm$^3$. The weight after packing varied within ±1% for either material after twenty repetitions of the packing tests. From this result, it was confirmed that light and fluffy material, such as flour and aluminum fiber could be rapidly packed by the present packing method with a high packing density, and the packing quantity was stable with little fluctuation.

As described so far referring to some of the examples, materials which are difficult to weigh and pack into a small space such as powder, staples, and feathery materials can be packed rapidly into a certain space. In addition, the weight of the packed material is stable with very little fluctuation, and the packing-density is uniform throughout the packed space. By controlling the conditions for the air tapping, the packing density can be controlled, and, when necessary, it can be increased to a high degree. By providing the opening of the feeding hopper with a grid element, an automated apparatus with a simple structure in which the material does not scatter around the container can be realized, and such apparatus has high productivity.

This invention is very effective for packing a material such as powder, staples and feathery materials which are difficult to weigh and pack into a small space.

A typical material which is easy to pack is liquid. A certain volume of a liquid provided in a container is easily transferred to another container rapidly with the volume constant. The packing method of the present invention enables such materials that are difficult to treat to be packed into a container precisely weighed and easily as when treating a liquid.

Figure 14B:
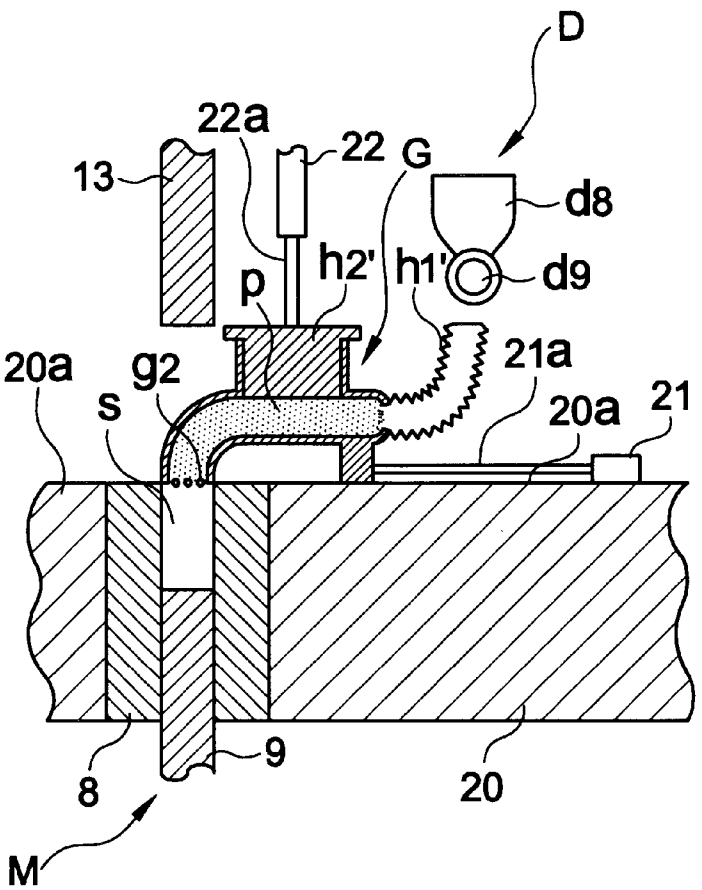
FIGS. 14*a* and 14*b* are a vertical cross-sectional view of a part of another embodiment of the present invention including a die and a feeding hopper illustrating a process of producing a powder compact.
Figure 14A:
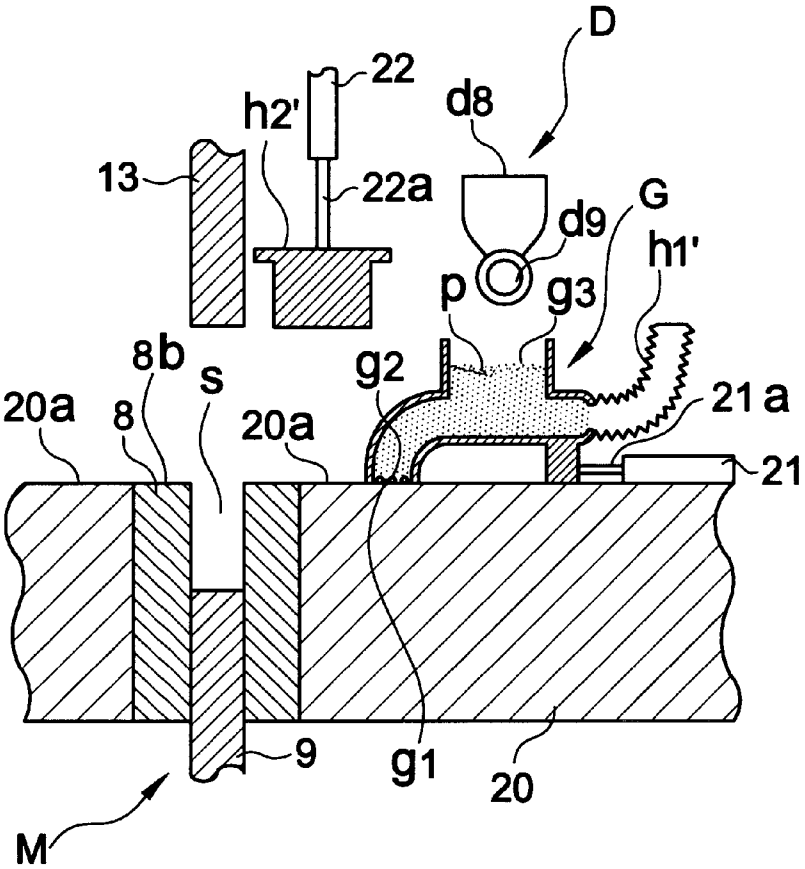
Figure 15B:
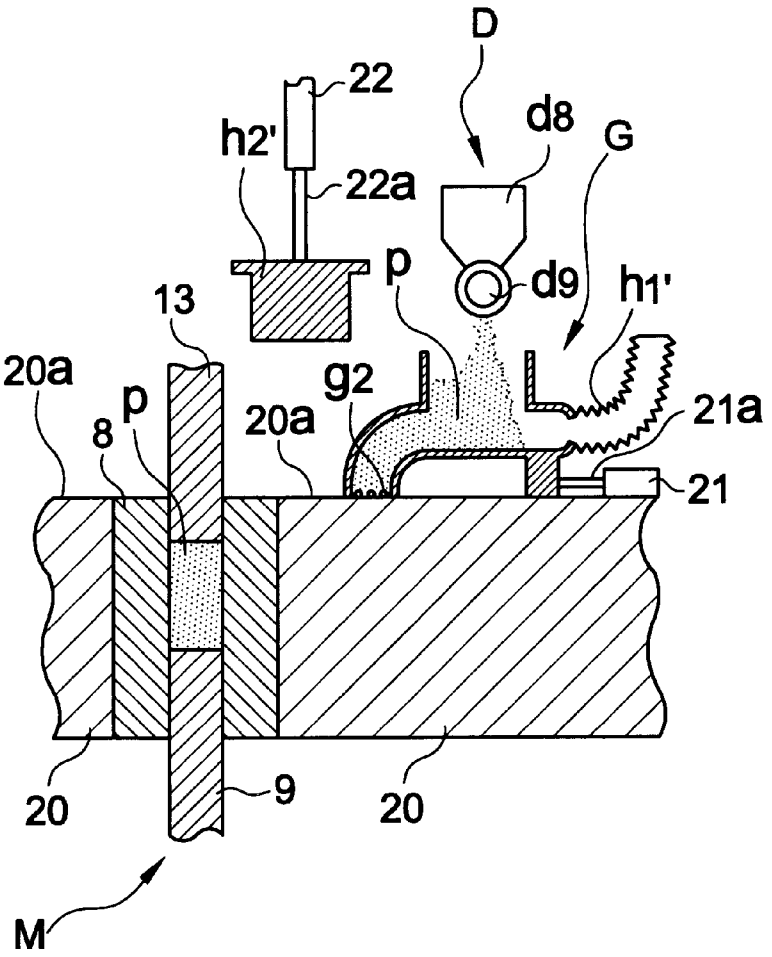
FIGS. 15*a* and 15*b* are is a vertical cross-sectional view of the same part as in FIG. 12 illustrating a process following the process shown in FIG. 14.
Figure 15A:
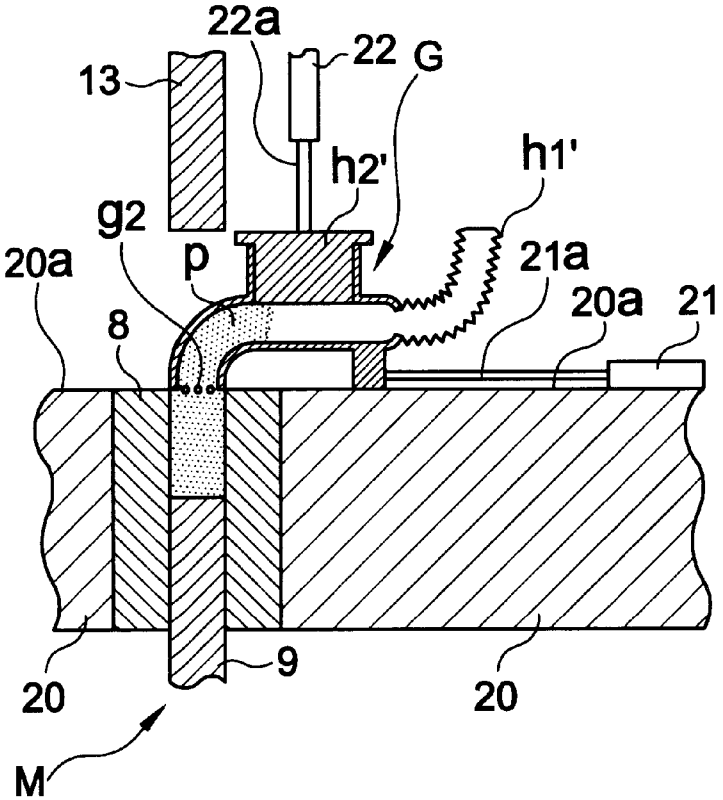
Figure 16B:
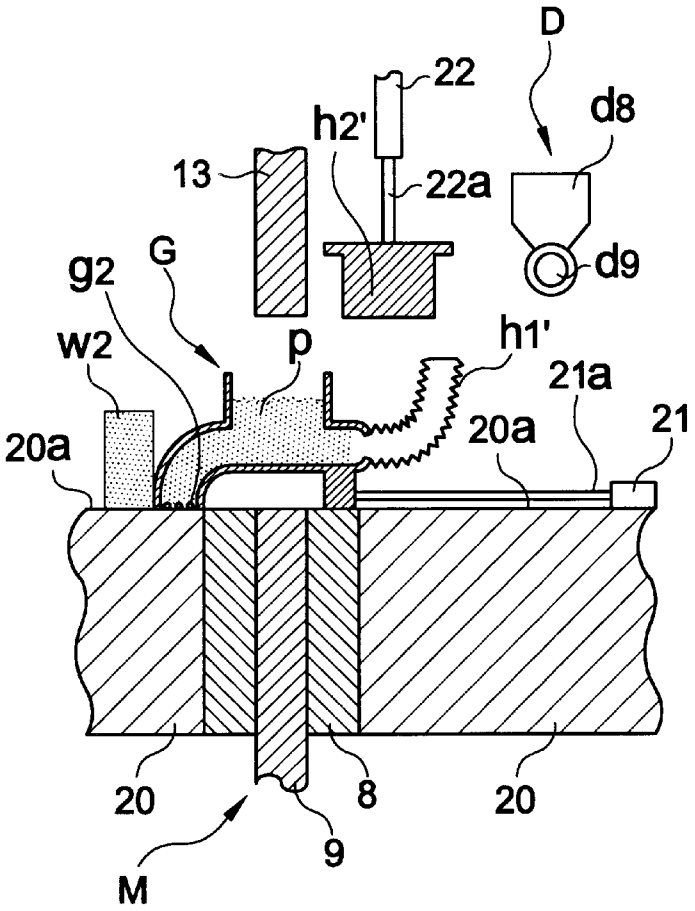
FIGS. 16*a* and 16*b* are a vertical cross-sectional view of the same part as in FIG. 12 illustrating a process following the process shown in FIG. 15.
Figure 16A:
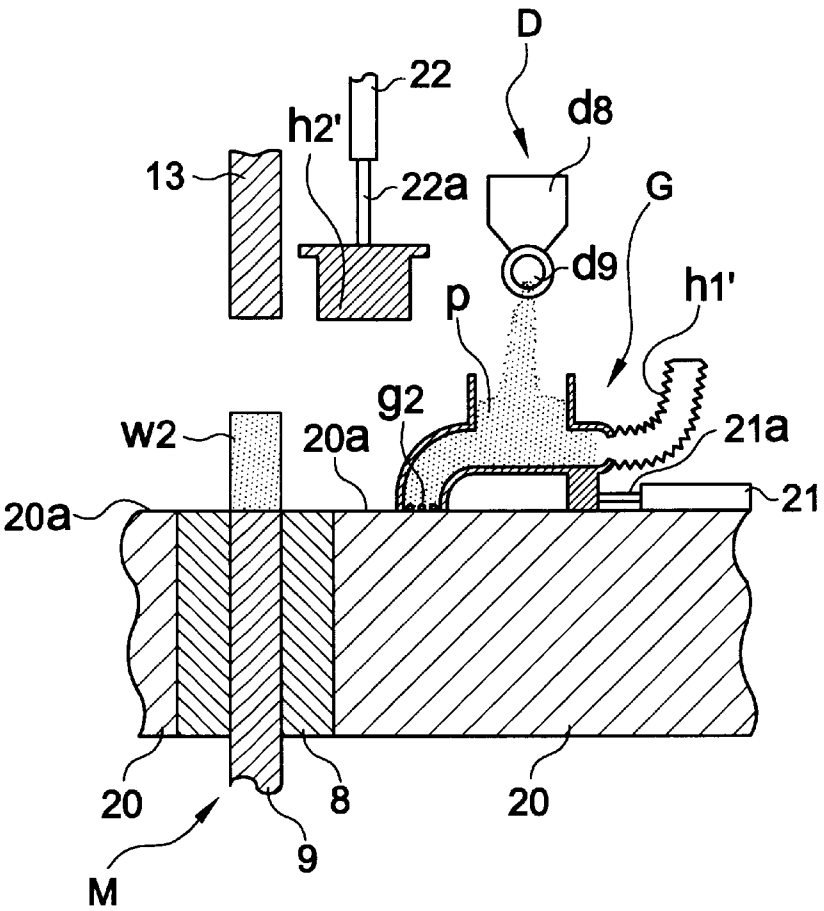

Referring now to FIGS. 14, 15 and 16, another embodiment of the present invention is explained.

In this embodiment, the height of the feeding hopper G is designed to be as low as possible. Too tall feeding hopper compels the upper punch to stand by at the point much higher than the top end 8*b* of the cylindrical body 8. This means that the upper punch is required to be very long in order to press the powder after the feeding hopper is slid after completion of the powder packing. If the upper punch is too long, it makes positioning against the cylindrical body 8 difficult. It may impede straight insertion of the upper punch into the cylindrical body, and cause the upper punch or the cylindrical body to break. In addition, too long an upper punch itself tends to bend and break. In order to avoid such a problem, the height of the feeding hopper should be designed to be as small as possible.

In FIG. 14(*a*), denoted by 20 is a table designed so as to surround the cylindrical body 8, and its upper surface 20*a* is designed to be flush with the upper end 8*b* of the cylindrical body 8. The height of the feeding hopper G is designed to be as low as possible. Like the other already mentioned embodiments, the feeding hopper G of the present example is also provided with a bottom opening g1 and a grid element g2 attached thereto. The bottom opening g1 contacts with the upper surface. 20*a* of the table 20. A piston rod 21*e* of the horizontal cylinder 21 provided on the surface of the table 20 is connected with the feeding hopper G at its end. As shown in FIG. 14(*b*), the bottom opening g1 of the feeding hopper G is designed so as to cover the cavity s formed by the cylindrical body 8 and the lower punch 9 at the position where the piston rod 21*a* is forwarded driven by a horizontal cylinder 21, and to contact with the upper surface 20*a* of the table 20 at the position in FIG. 14(*a*) where the piston and 21*a* is drawn back or on standby.

At the position of the feeding hopper G being on standby in FIG. 14(*a*), the outlet d9 of a powder supplier D provided with a powder storing hopper d8 is located above the feeding hopper G. An air evacuation/introduction pipe h' 1 functioning in the same way as the above-mentioned air evacuation/introduction pipe h is connected to the high/low air-pressure generator E. The powder supplier D contains a screw feeder G by whose rotation the powder stored in the powder storing hopper d8 is injected from the outlet d9 into the upper opening g3 of the feeding hopper G. A cover device h2' is located above the upper opening g3 of the feeding hopper G at the position where the piston rod 21*a* is forwarded. The cover device h2' is provided at the end of a piston rod 22*a* of a vertical cylinder 22. An upper punch to be inserted into the cylindrical body 8 is denoted by 18.

Now the process of the packing and producing a powder compact in the above-mentioned embodiment is described.

Starting from the location in FIG. 14(*a*), the horizontal cylinder 21 is driven to move the feeding hopper G forward, and as in FIG. 14(*b*), the bottom opening g1 of the feeding hopper G is placed so as to cover the cavity s. Then the vertical cylinder 22 is driven to lower the piston rod 22*s* so that the upper opening g3 of the feeding hopper G is covered with the cover device h2'.

Then, the air inside the feeding hopper G is sucked by the high/low air-pressure generator through the air evacuation/introduction pipe h1' so that the inside of the feeding hopper G is brought to a low-air-pressure state. Subsequently, the main valve e3' provided in the pipe e2 of the high/low air-pressure generator is closed, or air is rapidly introduced through the air evacuation/introduction pipe h1 into the feeding hopper G so as to make the inside of the feeding hopper G attain a high-air-pressure state. This cycle is repeated appropriate times. During this process, if the powder p becomes agglomerated and hard to flow out of the feeding hopper G, the magnetic or mechanical agitation described above is applied to the vicinity of the bottom opening g1 of the feeding hopper G so as to break up the agglomeration. Such a process of powder-releasing is carried out before the air tapping process or during the same. Through the air tapping process described above, the powder in the feeding hopper G is packed into the cavity s of the rubber mole through the grid element g2, and the powder exists both in the feeding hopper G and the cavity s.

Subsequently, the horizontal cylinder is driven again to draw back the feeding hopper G to the standby position as shown in FIG. 15(*b*). During this process, the powder p is divided into the powder in the cavity s and the powder remaining in the feeding hopper G. Then the upper punch 13 is moved down to be inserted into the cylindrical body 8, and then the powder p is compressed between the upper punch 13 and the lower punch 9. The feeding hopper G may be supplied with additional powder by rotating the screw feeder contained in the powder supplier D and injecting the powder from the outlet d9. After pressing the powder with the upper punch 13 and the lower punch 9, the lower punch is moved upward so that its upper surface is flush with the upper end 8*b* of the cylindrical body 8 and the upper surface 20*a* of the table 20. Subsequently, the horizontal cylinder 21 is driven to move the feeding hopper G to proceed further than the position in the above mentioned embodiment so that the obtained powder compact W2 is pushed onto the upper surface 20*a* of the table 20. The powder compact W2 is then conveyed by a robot or the like to the next stage such as the sintering process. Instead of pushing the powder compact W2 onto the surface of the table 20 with the feeding hopper G driven by the horizontal cylinder 21, it is also possible to move the powder compact W2 to a place over the cylindrical body 8 with the use of another cylinder or robot.

Figure 19B:
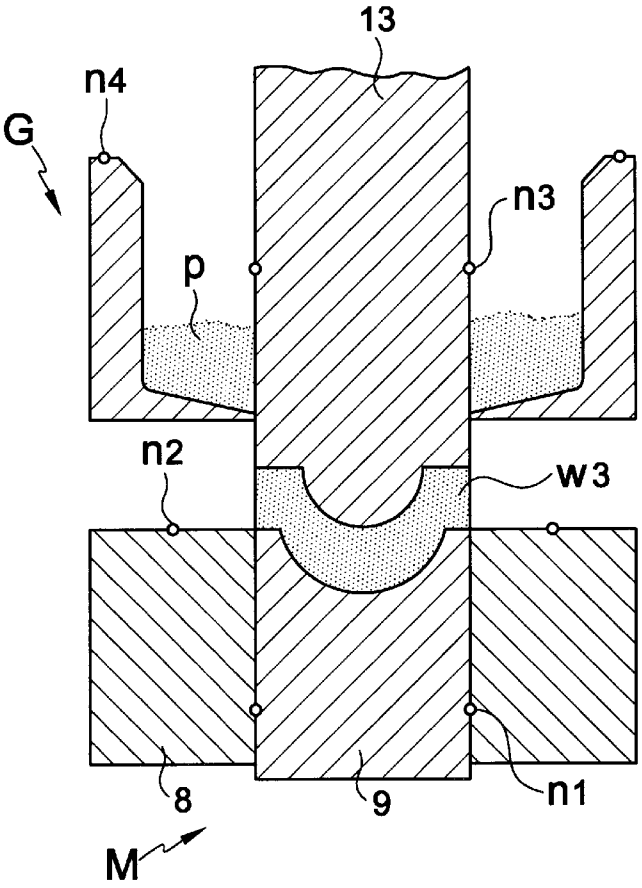
FIGS. 19*a* and 19*b* are a vertical cross-sectional view of the same part as in FIG. 12 illustrating a process following the process shown in FIG. 18.
Figure 19A:
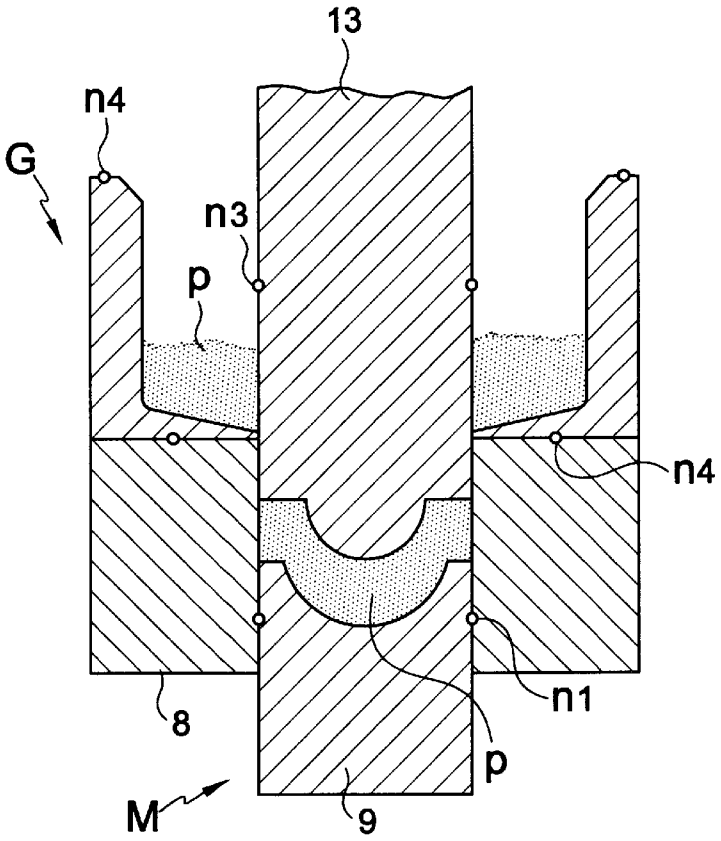
Figure 20B:
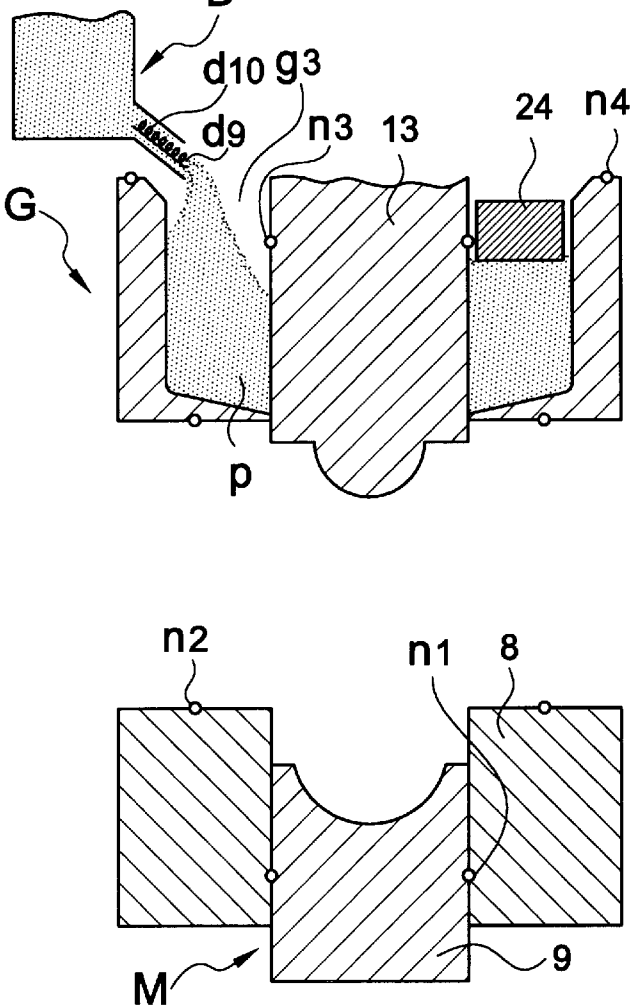
FIGS. 20*a* and 20*b* are a vertical cross-sectional view of the same part as in FIG. 19 illustrating a process following the process shown in FIG. 19.
Figure 20A:
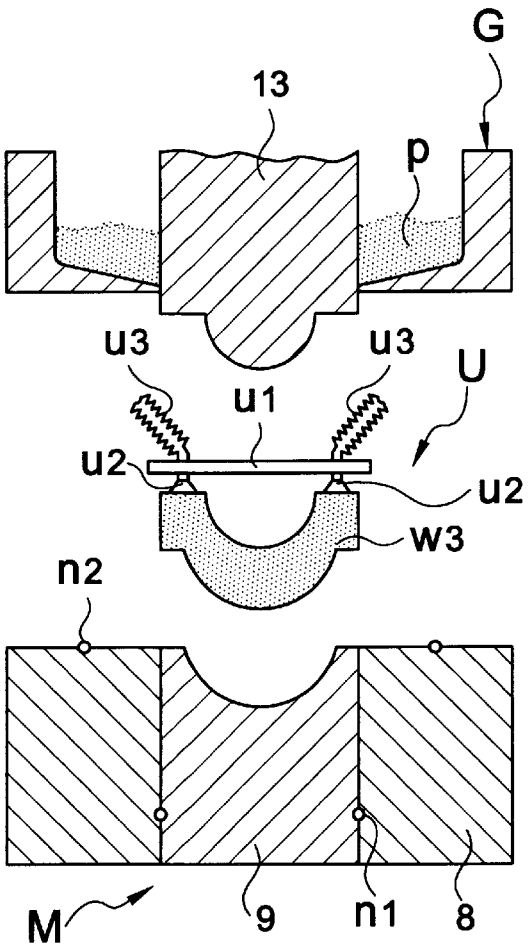

Now, another embodiment of the present invention in which a compact W8 consisting of a hemisphere w4 and a flange w5 formed around the opening of the hemisphere is produced is described referring to FIGS. 18, 19 and 20.

Figure 17:
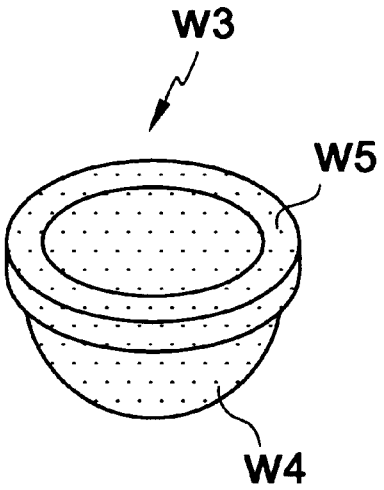
FIG. 17 is a perspective view of an embodiment of a powder compact produced by the apparatus of the present invention.

In this embodiment, the cavity s is formed by the inner and extended surfaces of a cylindrical body 8, the upper surface of the lower punch 9 and the bottom surface of the upper punch 13. The bottom opening g1 of a feeding hopper G placed on the upper end 8*b* of the cylindrical body 8 is shaped almost corresponding to the shape of the upper opening of the cylindrical body 8. The feeding hopper G is provided with a slanting wall g5 whose diameter gradually increases as it ascends from the bottom opening g1. From the slanting wall g5 to the upper opening g3, an inside wall g6 with a diameter larger than the outer diameter of the upper punch 19 extends. In the bottom of the upper punch 13, a hemisphere 13*a* having a diameter less than the thickness of the hollow hemisphere W4 is formed. A scaling element provided between the cylindrical body 8 and the lower punch 9 is denoted by n1. Another sealing element n2 is provided between the lower punch 9 and the feeding hopper G. Other scaling elements provided around the upper punch 13, on the feeding hopper G are denoted by n3 and n4, respectively. When producing a powder compact as W8 shown in FIG. 17, the feeding hopper G is mounted on the upper end 8*b* of the cylindrical body 8, and the upper punch 13 is placed inside the feeding hopper G so that a certain space 28 is formed between the upper punch 13 and the cylindrical body 8. Subsequently, a screw d10(shown in FIG. 20(*b*)) provided inside the powder supplier D is rotated, thereby injecting the powder p into the cavity s and to a desired depth of the feeding hopper G.

Then, the feeding hopper G is covered with a cover device h2 provided with an appropriate number of air evacuation/introduction pipes h1 as well as a through hold h2" into which the upper punch 13 is inserted surrounded by the sealing element n3. Then, the air inside the feeding hopper G is sucked by the high/low air-pressure generator through the air evacuation/introduction pipe h1 so that the inside of the feeding hopper G is brought to a low-air-pressure state. Subsequently, the main valve e8 provided in the pipe e2 of the high/low air-pressure generator is closed, or air is rapidly introduced through the air evacuation/introduction pipe h1 into the feeding hopper G so as to make the inside of the feeding hopper G attain a high-air-pressure state. This cycle is repeated an appropriate number of times. During this process, if the powder p becomes agglomerated and hard to flow out of the feeding hopper G, the magnetic or mechanical agitation described above is applied to the vicinity of the bottom opening g1 of the feeding hopper G so as to release the agglomerated powder from the grid element g2. Such an agitation for releasing the powder is carried out before or during the air tapping process. Through the process described above, the powder in the feeding hopper G is packed into the cavity s of the rubber mold m evenly and highly densified as shown in FIG. 18(*b*). Also in this case, the powder exists both in the container and in the feeding hopper G.

Subsequently, as shown in FIG. 19(*a*), the cover device h2 provided with air evacuation/introduction pipes h1 is detached, and then the upper punch 19 and the lower punch 9 are simultaneously moved down so as to divide the powder into the powder inside the feeding hopper G and the powder to be compacted. Then the upper punch 18 is slowly lowered so as to press the powder p between the upper punch 13 and the lower punch 9, thereby obtaining a powder compact. After the pressing, as shown in the FIG. 19(*b*), the upper punch 13 and the feeding hopper G are moved upward with the upper punch 13 being inserted into the feeding hopper G from the bottom opening g1 of the feeding hopper G so that the powder p remaining in the feeding hopper G may not fall from the bottom opening g1, and simultaneously with the lifting of the upper punch 13 and the feeding hopper G, the lower punch 9 is lifted so as to sandwich the powder compact W3 between the upper punch 13 and the lower punch 9, and to project a part of the powder compact W8 from the upper end 8*b* of the cylindrical body 8. Then, the upper punch 13 and the feeding hopper G are further moved upward.

Subsequently, as shown in FIG. 20(*a*), a conveyer device U comprising vacuum pads u2 attached to a moving element u1 which is provided in an arm part of a robot or the like and pipes u3 connected to an air-pressure generator not shown in the Figure hold the powder compact W3 sucked with the vacuum pads u2. The conveyer device U is lifted so as to take out the powder compact W3. Then, as shown in FIG. 20(*b*), the powder supplier D is located above the upper opening of the feeding hopper G with the upper punch 13 inserted therein, and the screw d10 is rotated so as to supply the feeding hopper G with additional powder from the outlet d9 for the next production step. It is preferable to level the surface of the powder supplied in the feeding hopper G with a spatula 24.

Figure 21:
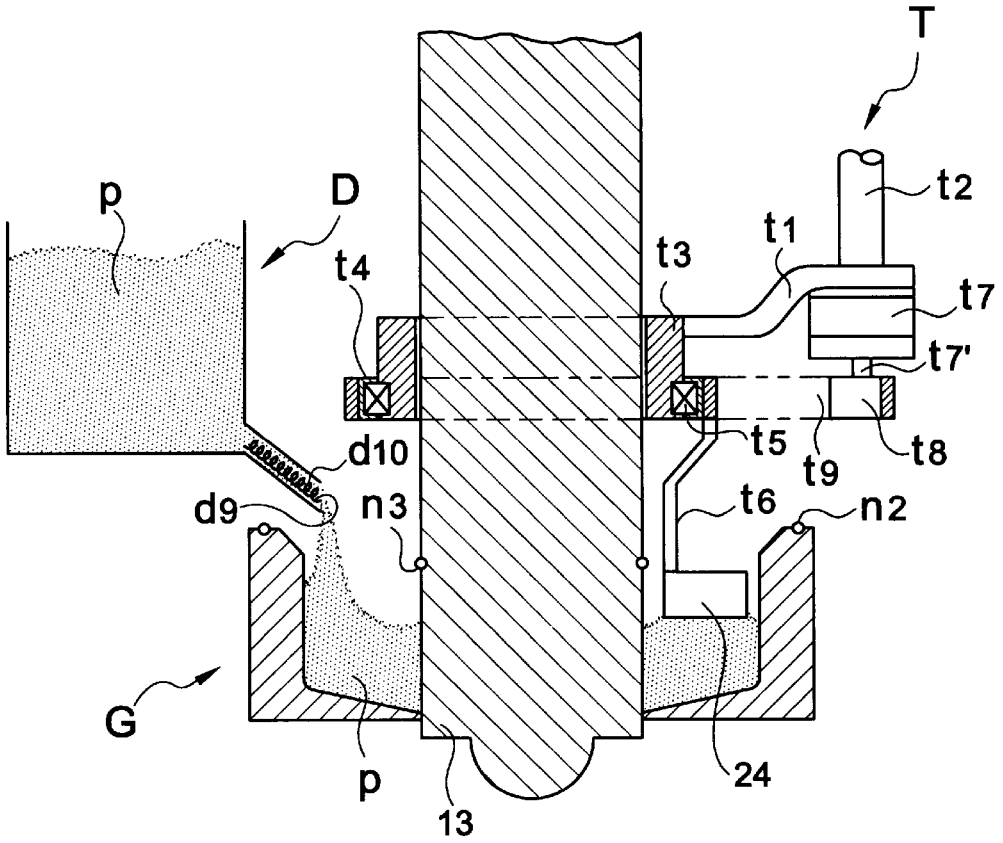
FIG. 21 illustrates in vertically elevation and partially in section an embodiment of a device for driving the leveling spatula.

FIG. 21 illustrates an example of an apparatus T for automatically driving the spatula 24 for leveling the powder p supplied in the feeding hopper G.

Denoted by t1 is a horizontal frame attached to a rod t2 suspended from a frame which is not shown. The horizontal frame t1 is provided with a cylindrical supporting element t3 into which an upper punch 13 is inserted. The supporting element t3 is provided with a ring t4 mediated by a bearing t5. To the ring t4, a rod t6 with the above mentioned spatula 24 is attached. A motor attached to the horizontal frame t1 is denoted by t7 of which an output shaft is provided with a pulley t8. An endless belt t9 is held by the pulley t8 and the ring t4.

When carrying out the leveling of the powder p, the motor t7 is driven to rotate the pulley t8 attached to the output shaft t7' so that the endless belt t9 is circulated rotating the ring t4 attached through the bearing t5 to the supporting element t8, and so that the spatula 24 provided at the end of the rod t6 connected to the ring t4 moves around the upper punch 18. Thus, the surface of the powder p supplied from the powder supplier D into the feeding hopper G is leveled. It is also possible to attach the horizontal frame t1 to a piston rod of a cylinder so that with the movement of the cylinder, the horizontal frame moves up and down, thereby moving the spatula 24 vertically.

Figure 22:
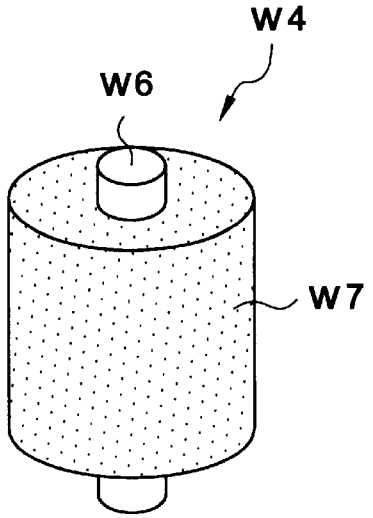
FIG. 22 is a perspective view of an embodiment of a powder compact produced by the apparatus of the present invention.

Referring now to FIGS. 22, 23, 24, and 25, an embodiment of the present invention when producing by cold isostatic pressing a powder compact as shown in FIG. 22 is described. In this embodiment, a powder compact W4 consisting of a columnar core w6 and cylindrical part w7 surrounding the columnar core w6 is produced as one body.

Figure 23A:
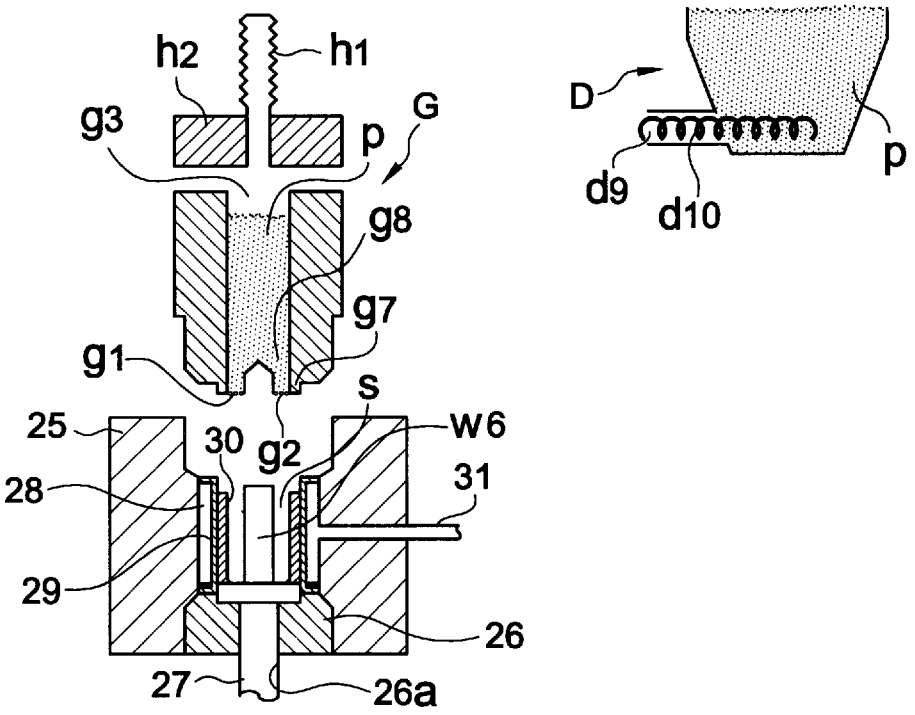
FIGS. 23*a* and 23*b* are a vertical cross-sectional view of a part of an apparatus including a die and a hopper in a process for producing a powder compact as shown in FIG. 22.
Figure 23B:
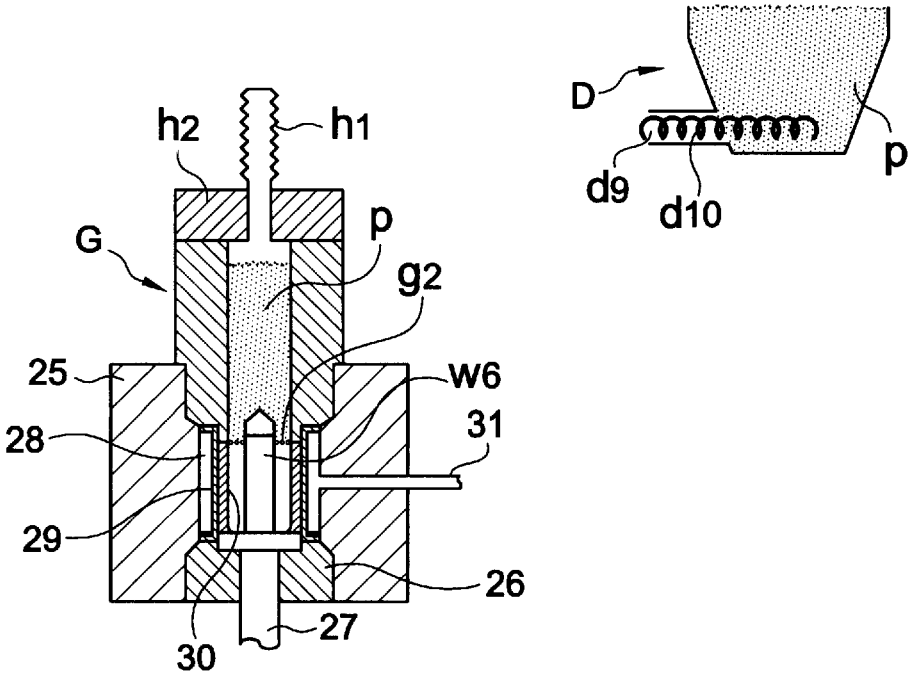

In FIG. 23, a cylindrical pressure vessel is denoted by 25. A bottom part 26 provided with a hole 26*a* into which a core rod 27 for supporting a core part w6 can be inserted is provided in the bottom of the pressure vessel 25. The inside of the pressure vessel 25 features a generally so-called dry CIP structure. That is, across a thin space 28, an outer rubber mold 29 made of a relatively thin rubber is provided, and an inner rubber mold 30 made of a relatively thick rubber is provided inside of the rubber mold 29. Lips are formed at the upper and lower ends of the outer rubber mold 29 so as to seal the space 28 and prevent liquid from leaking when the space 28 is filled with a liquid and subjected to a high pressure. The upper surface of a core rod 27 is provided with a recess into which the columnar core w6 is inserted. To the space 28 forming a clearance between the pressure vessel 25 and the outer rubber mold 29, a liquid supplying pipe 31 is connected penetrating the pressure vessel 25. The liquid supplying pipe 31 is connected to a high-pressure liquid supply not shown in the Figure. The outer rubber mold 29 functions to transfer the pressure generated in the space 28 above, and the inner rubber mold 30 functions as a mold to give the powder packed inside the rubber mold 30 a shape and desired dimensions. Therefore, the outer rubber mold 29 is called the pressure rubber mold, and inner rubber mold 30 is called the compaction rubber mold. In this embodiment, the space inside the inner rubber mold 30 corresponds to the cavity s in the other embodiments.

The bottom opening of a feeding hopper G is provided with a cylindrical part g7 into which the upper part of a columnar core w6 can be inserted. A grid element g1 is provided between the lower end of the cylindrical part g7 and the bottom of the feeding hopper G. The cylindrical part g7 may be provided in the feeding hopper G with the grid element g1, and may be attached to the ends of plural connected rods g8 provided inside the feeding hopper G. In this embodiment, the bottom of the feeding hopper G is designed to have a small diameter so that it can be inserted into the upper opening of the pressure vessel 25, and is designed so that when the feeding hopper G is lowered to its greatest extent, the bottom opening g1 of the feeding hopper G just fits the upper opening of the container of the inner rubber mold 30. A cover device h2 is provided, as in the other examples, with an air evacuation/introduction pipe hi. Denoted by D is a powder storing hopper from whose exit d9 the powder is let out by turning a screw d10 provided in said hopper.

The process for producing a powder compact in the above described embodiment is as follows:

In the standby condition shown in FIG. 23(*a*), the feeding hopper G located above the pressure vessel 25 is preliminarily supplied with the powder p from the powder storing hopper D in an amount more than that to be packed in the cavity s. The feeding hopper G is lowered so that the bottom part of the feeding hopper G is inserted into the upper part of the pressure vessel 25 as shown in FIG. 23(*b*), as well as the upper part of the columnar core w6 is inserted into the cylindrical part g7 of the feeding hopper G. The upper opening of the feeding hopper G is covered with the cover device h2 provided with the air evacuation/introduction pipe h1.

Subsequently, the air inside the feeding hopper G is sucked by the high/low air-pressure generator through the air evacuation/introduction pipe h1 so that the inside of the feeding hopper G is brought to a low-air-pressure state. Subsequently, the main valve e3 provided in the pipe e2 of the high/low air-pressure generator is closed, or air is rapidly introduced through the air evacuation/introduction pipe h1 into the feeding hopper G so as to make the inside of the feeding hopper G attain a high-air-pressure state. This cycle is repeated an appropriate number of times. During this process, if the powder p becomes agglomerated and hard to flow out of the feeding hopper G, the magnetic or mechanical agitation described above is applied to the vicinity of the bottom opening g1 of the feeding hopper G so as to release the agglomerated powder from the grid element g2. Such an agitation for releasing the powder is carried out before or during the air tapping process. Through the process described above, the powder in the feeding hopper G is packed into the cavity s of the rubber mold m evenly and highly densified as shown in FIG. 18(*b*). Also in this case, the powder exists both in the container and in the feeding hopper G.

Figure 24A:
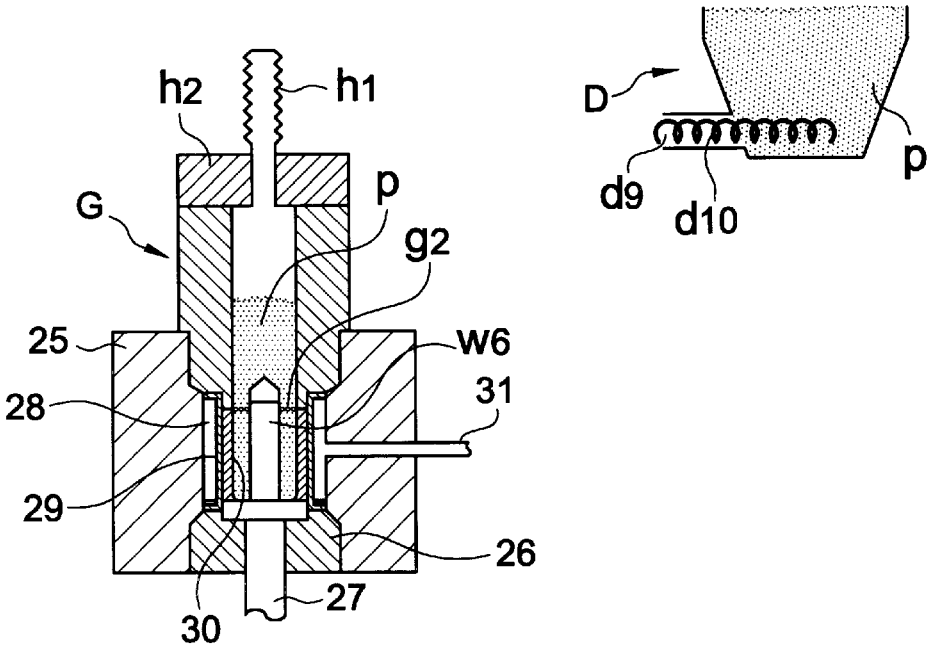
FIGS. 24*a* and 24*b* are a vertical cross-sectional view of the same part as in FIG. 23 in a process following the process as shown in FIG. 23.
Figure 24B:
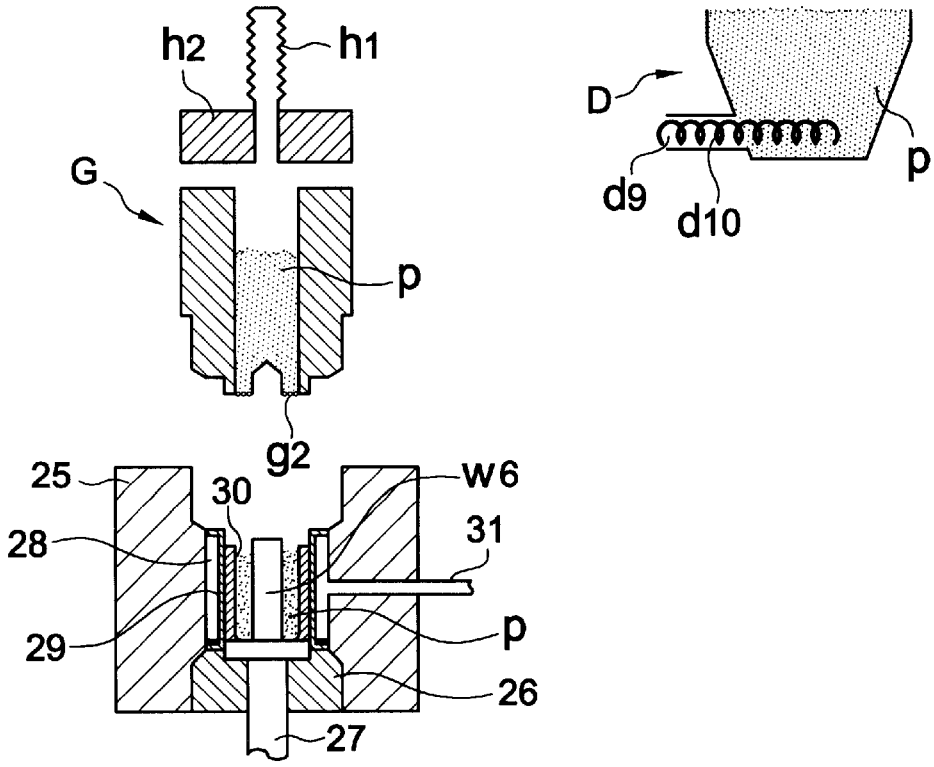

After the above powder-packing process, as shown in FIG. 24(*b*), the feeding hopper G is lifted to be taken out of the pressure vessel 25, and the cover device h2 is detached. While the feeding hopper G is lifted, the powder is divided into the powder in the cavity s and that in the feeding hopper G. The powder in the feeding hopper G does not fall because the grid element g2 provided in the bottom opening of the feeding hopper G holds the powder on it.

Figure 25A:
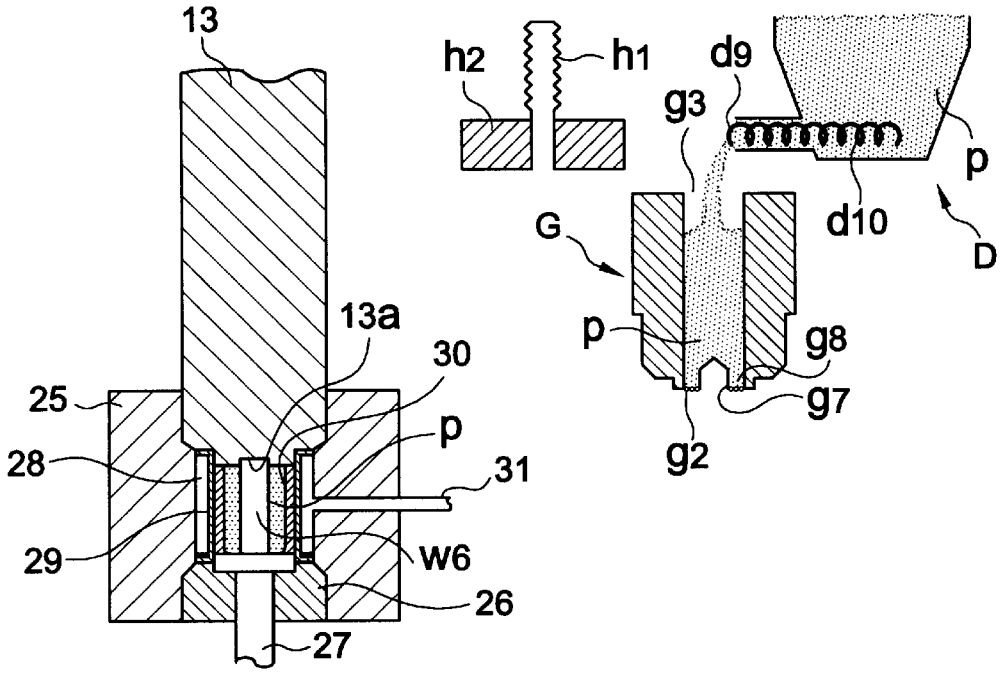
FIGS. 25*a* and 25*b* are a vertical cross-sectional view of the same part as in FIG. 23 in a process following the process shown in FIG. 24.
Figure 25B:
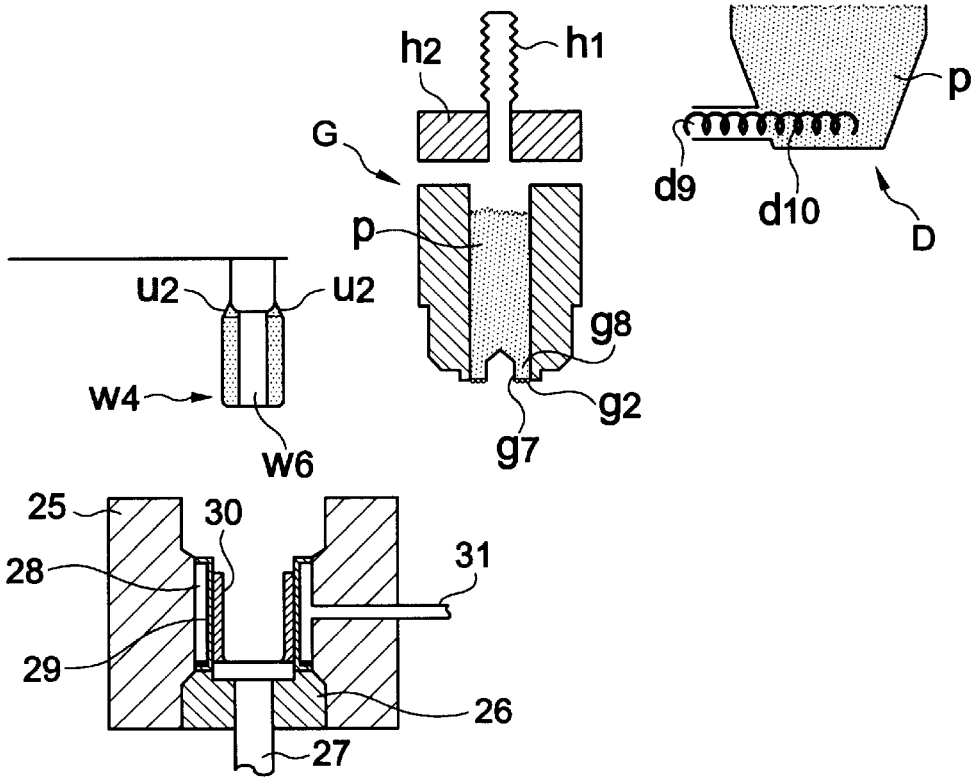
Figure 26:
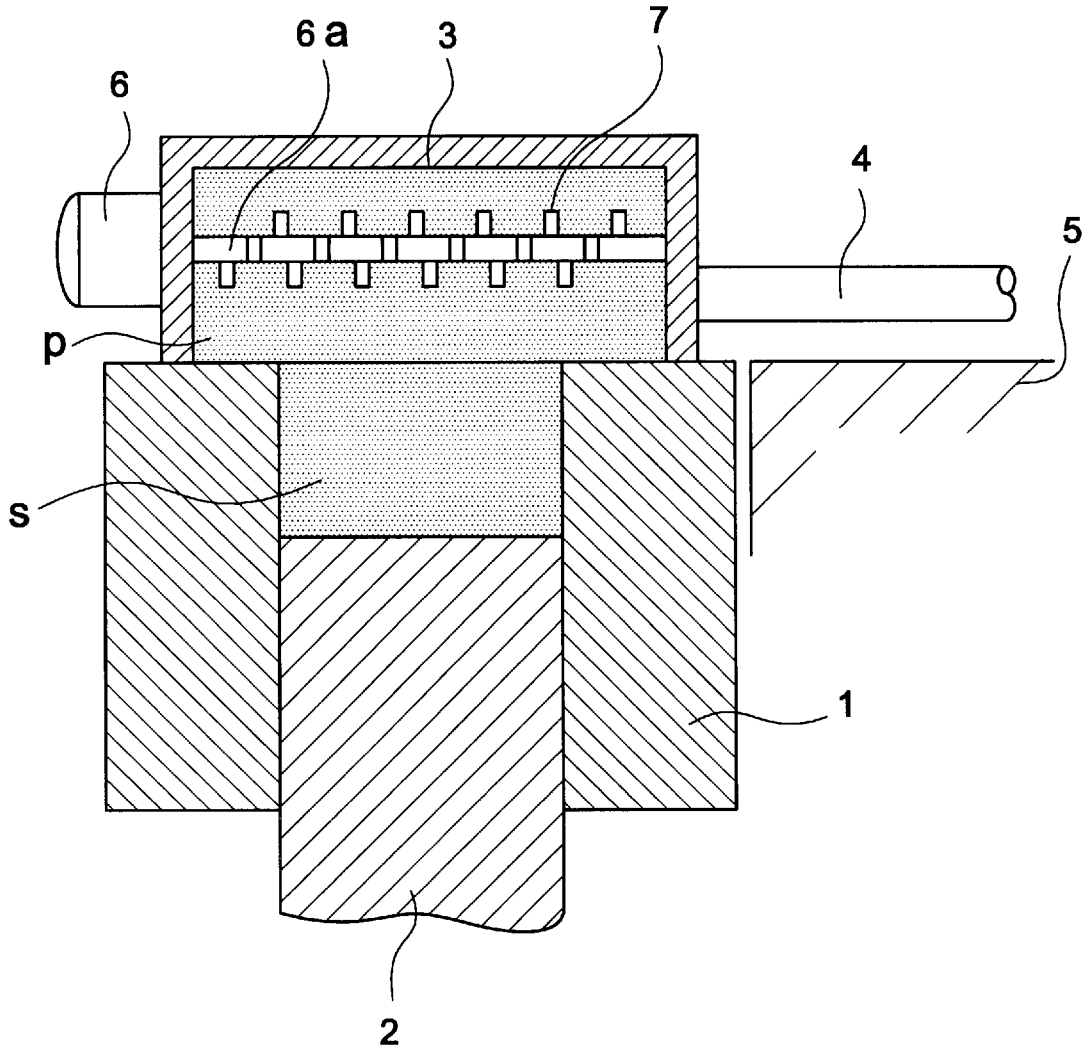
FIG. 26 is a vertical cross-sectional view of a device for packing a cavity with powder used in a conventional apparatus for producing a powder compact.

Subsequently, as shown in FIG. 25(*a*), the upper punch 13 is inserted into the pressure vessel 25. The upper punch 13 prevents the outer rubber mold 29 and the inner rubber mold 30 from sticking out of the pressure vessel 25, as well as functions to prevent the powder from flowing out of the inner rubber mold 30. Therefore, the upper punch 13 is provided with an appropriate number of sealing elements. The central part of the bottom surface of the upper punch 13 is provided with a recess 13*a* into which the upper part of the core w6 may be inserted. This part is also provided with a sealing element so as not to allow the powder to flow into this recess. A high-pressure liquid supplier not shown in the Figure supplies the space 28 between the pressure vessel 25 and the outer rubber mold 29 with a liquid through the liquid supplying pipe 31 so that the powder packed into the cavity s is compressed. While the powder p in the cavity s is compressed, the feeding hopper G is moved in the direction of the powder supplier D, and the screw 10 is turned so as to supply the feeding hopper D with the powder p.

Subsequently, the upper punch 13 is detached from the pressure vessel 5, and the core w6 together with the powder compact. W4 is taken out with the vacuum pad u2 or a holding device of a robot from the cavity s. The side wall of the core w6 should be provided with an appropriate projection or recess so that it can be firmly held in the compact.

As described so far referring to some examples, in the present invention, the powder is not only rapidly packed into a certain space, but also has a uniform density throughout the packed space with little scattering in quantity at every packing. It means that the resultant compacts can be near-net-shaped, and productivity can be enhanced. By arranging the conditions for the air tapping, the packing density can be controlled, and can be very high when it is required. Being able to control the packing density by arranging the conditions for the air tapping, that is, being able to control the quantity of the powder to be packed, the present invention can control the weight of the resultant powder compact. By measuring the weight of the compact after pressing and comparing it to the aimed value, the difference is reflected by the conditions for the air tapping. The weight and size of the compact can be therefore accurately controlled and vary little in weight or in size even in continuous production. In addition, by providing the opening of the feeding hopper with a grid element, troubles such as powder scattering around the container can be prevented, which also enhances productivity.

The present invention has the following advantages when applied to die pressing, cold isostatic pressing (CIP), or rubber isostatic pressing (RIP): (1) the weight and size of the powder compact does not fluctuate because of the constant quantity of the packed powder, (2) deformations such as the "elephant foot" deformation which often occurs upon pressing in CIP and RIP can be minimized because of the highly densified packing, and (3) in die pressing, the shortened traveling distance of punches prevents the powder from being caught in the clearance between punches and the die, which improves the durability of the die.

When tall pats or parts which complex shapes are produced by die pressing, because of the uneven packing density of the powder in the die, the compact after pressing has an uneven green density, resulting in a largely deformed shape, chipping or cracking after sintering. However, when the present invention is applied to production of such parts, because of the highly and uniformly densified packing throughout the cavity, such deformation, chipping or cracking does occur during pressing or sintering. The present invention therefore enhances the productivity as well as performance of the product by minimizing the scattering of the weight and size as well as the defect rate, while making products near-net shaped.

In the above embodiments, air is used for the air tapping. However, if the powder is susceptible to oxidation or tends to have other chemical reactions, nitrogen has or argon gas may of course be used instead of the atmospheric air.

Being constructed as described so far, the present invention has the following effects:

Materials can be rapidly packed into a certain space, and the quantity of the packed material is constant at every time of packing while the density is kept uniform throughout the space of the container. Even the materials such as powder, staples, and feathery materials which are difficult to pack into a small space can be rapidly packed into a container with a high and stable packing density.

By arranging the conditions for the air tapping, the packing density can be controlled, and can be very high when required.

Because the feeding hopper is provided with a grid element, the material is surely be divided after packing into two parts, i.e., the material in the feeding hopper and the material packed in the cavity, while dropping of the material from the feeding hopper is prevented, automatic apparatuses with high productivity for packing or weighing material including materials difficult to weight and pack is realized in a simple structure.

We claim:

1. A method for packing a material comprising the steps of:

air tapping for packing the material provided in a feeding hopper into a container to be filled with said material, and separating the material existing in both the feeding hopper and the container into a portion of the material packed in the container where the material has a uniform density and a portion of the material remaining in the feeding hopper.

2. A method for packing a material according to claim 1, in which the portion of the material remaining in the feeding hopper is separated from the portion of the material packed in the container where the material has a uniform density by a grid provided in the opening of the feeding hopper located toward the container.

3. A method for packing a material according to claim 1 or 2, in which the container to be packed with the material comprises a cavity of a die used in the die pressing.

4. A method for packing a material according to claim 1 or 2, in which the container to be packed with the material comprises at least one cavity of a rubber mold used in cold isostatic pressing.

5. A method for packing a material according to claim 1 or 2, in which the container to be packed with the material comprises at least one cavity of a rubber mold us ed in rubber isostatic pressing.

6. An apparatus for packing a material comprising:

a feeding hopper for feeding the material into a container, means for air tapping for packing the material provided in the feeding hopper into the container to be packed with said material, and means for separating the material existing in both the feeding hopper and the container into a portion of the material packed in the container where the material has a uniform density and a portion of the material remaining in the feeding hopper.

7. An apparatus for compacting material according to claim 6, in which the means for separating the portion of the material remaining in the feeding hopper from the portion of the material packed in the container where the material has a uniform density comprises a grid provided in the opening of the feeding hopper located on a side toward the container.

* * * * *